US010875684B2

(12) United States Patent
Ross et al.

(10) Patent No.: US 10,875,684 B2
(45) Date of Patent: Dec. 29, 2020

(54) APPARATUS AND METHODS OF FORMING AND APPLYING ROLL-ON PILFER PROOF CLOSURES ON THE THREADED NECK OF METAL CONTAINERS

(71) Applicant: Ball Corporation, Broomfield, CO (US)

(72) Inventors: John R. Ross, Westminster, CO (US); David J. Bonfoey, Broomfield, CO (US); Dean L. Johnson, Littleton, CO (US)

(73) Assignee: BALL CORPORATION, Broomfield, CO (US)

( * ) Notice: Subject to any disclaimer, the term of this patent is extended or adjusted under 35 U.S.C. 154(b) by 254 days.

(21) Appl. No.: 15/896,937

(22) Filed: Feb. 14, 2018

(65) Prior Publication Data

US 2018/0229900 A1 Aug. 16, 2018

Related U.S. Application Data

(60) Provisional application No. 62/459,687, filed on Feb. 16, 2017, provisional application No. 62/527,760, filed on Jun. 30, 2017.

(51) Int. Cl.
*B65D 41/34* (2006.01)
*B65D 1/02* (2006.01)

(52) U.S. Cl.
CPC ..... *B65D 41/3428* (2013.01); *B65D 1/0246* (2013.01); *B65D 41/348* (2013.01); (Continued)

(58) Field of Classification Search
CPC ..... B65D 41/3409; B65D 41/3428; B65D 41/3423; B65D 41/34; B65D 41/3457; (Continued)

(56) References Cited

U.S. PATENT DOCUMENTS 2,038,524 A 4/1936 Carvalho
2,116,199 A 5/1938 Held
(Continued)

FOREIGN PATENT DOCUMENTS

CA 707608 4/1965
CA 720701 11/1965
(Continued)

OTHER PUBLICATIONS

U.S. Appl. No. 16/110,598, filed Aug. 23, 2018, Bonfoey et al.
(Continued)

*Primary Examiner* — Robert J Hicks
(74) *Attorney, Agent, or Firm* — Sheridan Ross P.C.

(57) ABSTRACT

Methods and apparatus for sealing a threaded container are provided. More specifically, the present invention relates to a ROPP closure with a novel pilfer band that may be used to seal a bottle shaped container without pressing directly against the bottle or deforming the bottle. The bottle includes an annular ring that is novel. Optionally, the annular ring can be formed without die necking or expanding the bottle neck. At least one protrusion which extends inwardly at least partially into the bottle annular ring is formed on the ROPP closure after the ROPP closure is positioned on the bottle neck. In one embodiment, the ROPP closure includes one inwardly oriented protrusion which extends around the circumference of the ROPP closure. The protrusion can be formed by a roller. Optionally, the protrusion has a substantially uniform depth. In another embodiment, the ROPP closure includes a plurality of individuals studs which each extend at least partially into the bottle annular ring. The individual studs can be formed by one or more of a punch, a stud roller, a studded rail, a collet actuated tool, and a cam actuated tool of embodiments of the present invention.

20 Claims, 17 Drawing Sheets

(52) U.S. Cl.
CPC ..... *B65D 41/3457* (2013.01); *B65D 41/3466* (2013.01); *B65D 2401/30* (2020.05)

(58) Field of Classification Search
CPC ..... B65D 41/3466; B65D 41/3461; B65D 41/348; B65D 1/0246; B65D 1/023; B65D 1/0223; B65D 1/0238; B23P 15/00
USPC ... 215/253, 252, 251, 250, 329, 316, 44, 43; 220/266, 276, 265; 29/516; 53/487, 488, 53/485, 484
See application file for complete search history.

(56) References Cited

U.S. PATENT DOCUMENTS 2,207,564 A 7/1940 Wackman
3,029,507 A 4/1962 Gaggini
3,144,964 A 8/1964 Goff et al.
3,147,721 A 9/1964 Holmes
3,164,287 A 1/1965 Williamson
3,227,318 A 1/1966 Rieder
3,232,260 A 2/1966 Siemonsen
3,537,291 A 11/1970 Hawkins
3,578,223 A 5/1971 Armour
3,603,472 A 9/1971 Lecinski, Jr. et al.
3,812,646 A 5/1974 Baldyga et al.
3,824,941 A 7/1974 Hannon
3,866,463 A 2/1975 Smith et al.
3,878,667 A 4/1975 Holstein
4,054,229 A 10/1977 Arfert
4,185,576 A 1/1980 George
4,232,500 A 11/1980 Holstein
4,243,438 A 1/1981 Yanagida et al.
4,260,419 A 4/1981 Robertson
4,282,044 A 8/1981 Robertson et al.
4,318,755 A 3/1982 Jeffrey et al.
4,392,580 A 7/1983 Ochs
4,403,493 A 9/1983 Atkinson
4,411,707 A 10/1983 Brennecke et al.
4,420,959 A 12/1983 King
4,466,548 A 8/1984 Herbert
4,693,108 A 9/1987 Traczyk et al.
4,732,027 A 3/1988 Traczyk et al.
4,823,537 A 4/1989 Duke
5,078,290 A 1/1992 Ochs
5,102,705 A 4/1992 Yammoto et al.
5,104,465 A 4/1992 McAuliffe et al.
5,110,545 A 5/1992 McAuliffe et al.
5,138,858 A 8/1992 Johnson et al.
5,174,145 A 12/1992 Tsuzuki
5,207,341 A 5/1993 Yeager
5,255,805 A 10/1993 Weiss et al.
5,293,765 A 3/1994 Nussbaum-Pogacnik
5,355,710 A 10/1994 Diekhoff
5,362,341 A 11/1994 Palmer et al.
5,394,727 A 3/1995 Diekhoff et al.
5,445,284 A 8/1995 Guest
5,448,903 A 9/1995 Johnson
5,469,729 A 11/1995 Hager
5,486,243 A 1/1996 Hashiguchi et al.
5,487,295 A 1/1996 Diekhoff et al.
5,503,690 A 4/1996 Wade et al.
5,522,248 A 6/1996 Diekhoff et al.
5,522,950 A 6/1996 Bartges et al.
5,551,997 A 9/1996 Marder et al.
5,571,347 A 11/1996 Bergsma
5,572,893 A 11/1996 Goda et al.
5,704,240 A 1/1998 Jordan
5,713,235 A * 2/1998 Diekhoff ..... B21D 51/2615 413/69
5,718,352 A 2/1998 Diekhoff et al.
5,769,331 A 6/1998 Yamagishi et al.
5,772,802 A 6/1998 Sun et al.
5,778,723 A 7/1998 Silverman et al.
5,806,707 A 9/1998 Boehm et al.
5,822,843 A 10/1998 Diekhoff et al.
6,010,026 A 1/2000 Diekhoff et al.
6,010,028 A 1/2000 Jordan et al.
6,100,028 A 8/2000 Cole et al.
6,126,034 A 10/2000 Borden et al.
6,171,362 B1 1/2001 Osumi et al.
6,301,766 B1 10/2001 Kollé
6,341,706 B1 1/2002 Neuner
6,355,090 B1 3/2002 Ohyama et al.
6,368,427 B1 4/2002 Sigworth
6,375,020 B1 4/2002 Marquez
6,543,636 B1 4/2003 Flecheux et al.
6,588,614 B2 7/2003 Neuner
6,607,615 B1 8/2003 Bekki et al.
6,626,310 B2 9/2003 Taha
6,627,012 B1 9/2003 Tack et al.
6,630,037 B1 10/2003 Sawada et al.
6,666,933 B2 12/2003 Roberts et al.
6,676,775 B2 1/2004 Barth et al.
6,713,235 B1 3/2004 Ide et al.
6,779,677 B2 8/2004 Chupak
6,907,653 B2 6/2005 Chupak
6,945,085 B1 9/2005 Goda
6,959,830 B1 11/2005 Kanou et al.
7,117,704 B2 10/2006 Ogura et al.
7,140,223 B2 11/2006 Chupak
7,147,123 B2 12/2006 Yamashita
7,171,840 B2 2/2007 Kanou et al.
7,294,213 B2 11/2007 Warner et al.
7,503,741 B2 3/2009 Gillest
7,520,044 B2 4/2009 Bulliard et al.
7,555,927 B2 7/2009 Hanafusa et al.
7,588,808 B2 9/2009 Hutchinson et al.
7,666,267 B2 2/2010 Benedictus et al.
7,713,363 B2 5/2010 Sano et al.
7,798,357 B2 9/2010 Hanafusa et al.
7,824,750 B2 11/2010 Takegoshi et al.
7,905,130 B2 3/2011 Marshall et al.
7,942,028 B2 5/2011 Gillest et al.
7,946,436 B2 5/2011 Laveault et al.
8,016,148 B2 9/2011 Walsh
8,037,728 B2 10/2011 Hosoi
8,037,734 B2 10/2011 Hanafusa et al.
8,091,402 B2 1/2012 Hanafusa et al.
8,132,439 B2 3/2012 Hanafusa et al.
8,132,687 B2 3/2012 Fedusa et al.
8,313,003 B2 11/2012 Riley et al.
8,349,419 B2 1/2013 Nishida et al.
8,360,266 B2 1/2013 Adams et al.
8,474,634 B1 7/2013 Branson et al.
8,496,131 B2 7/2013 Forrest et al.
8,505,350 B2 8/2013 Marshall et al.
8,631,632 B2 1/2014 Morales et al.
8,740,001 B2 6/2014 Hanafusa et al.
9,227,748 B2 1/2016 Nakagawa et al.
9,327,899 B2 5/2016 Greenfield et al.
9,409,433 B2 8/2016 Carreras
9,517,498 B2 12/2016 Siles et al.
9,663,846 B2 5/2017 Siles et al.
9,821,926 B2 11/2017 Robinson et al.
9,844,805 B2 12/2017 Siles et al.
2001/0003292 A1 6/2001 Sun et al.
2001/0031376 A1 10/2001 Fulton et al.
2002/0134747 A1 9/2002 Babcock et al.
2003/0102278 A1 6/2003 Chupak
2003/0132188 A1 7/2003 Beek et al.
2004/0025981 A1 2/2004 Tack et al.
2004/0035871 A1 2/2004 Chupak
2004/0140237 A1 7/2004 Brownewell
2004/0173560 A1 9/2004 Chupak
2004/0213695 A1 10/2004 Ferreira et al.
2005/0029219 A1 2/2005 Taber et al.
2005/0115294 A1 6/2005 Kanou et al.
2005/0127077 A1 6/2005 Chupak
2006/0169665 A1* 8/2006 Matukawa ..... B65D 51/1688 215/252
2007/0034593 A1 2/2007 Ichimura et al.
2007/0051687 A1 3/2007 Olson
2007/0062952 A1 3/2007 Kobayashi et al.

(56) References Cited

U.S. PATENT DOCUMENTS

| | | | | |
|---|---|---|---|---|
| 2007/0080128 | A1 | 4/2007 | Laveault et al. | |
| 2007/0175855 | A1* | 8/2007 | Penny | B29C 49/0073 215/383 |
| 2007/0295051 | A1 | 12/2007 | Myers et al. | |
| 2008/0022746 | A1 | 1/2008 | Myers et al. | |
| 2008/0041501 | A1 | 2/2008 | Platek et al. | |
| 2008/0047922 | A1 | 2/2008 | Olson et al. | |
| 2008/0073309 | A1* | 3/2008 | Nakajima | B65D 41/348 215/252 |
| 2008/0163663 | A1 | 7/2008 | Hankey et al. | |
| 2008/0181812 | A1 | 7/2008 | Ferreira et al. | |
| 2008/0299001 | A1 | 12/2008 | Langlais et al. | |
| 2009/0178995 | A1 | 7/2009 | Tung et al. | |
| 2009/0220714 | A1 | 9/2009 | Nishida et al. | |
| 2009/0277862 | A1 | 11/2009 | Masuda et al. | |
| 2010/0065528 | A1 | 3/2010 | Hanafusa et al. | |
| 2010/0199741 | A1 | 8/2010 | Myers et al. | |
| 2011/0113732 | A1 | 5/2011 | Adams et al. | |
| 2011/0114649 | A1 | 5/2011 | Adams et al. | |
| 2012/0024813 | A1 | 2/2012 | Nakagawa et al. | |
| 2012/0031913 | A1 | 2/2012 | Moore et al. | |
| 2012/0269602 | A1 | 10/2012 | Hanafusa et al. | |
| 2013/0199017 | A1 | 8/2013 | Kurosawa et al. | |
| 2013/0202477 | A1 | 8/2013 | Zajac et al. | |
| 2013/0313287 | A1 | 11/2013 | Walsh et al. | |
| 2014/0021157 | A1 | 1/2014 | Gren et al. | |
| 2015/0013416 | A1 | 1/2015 | Hosoi | |
| 2015/0020364 | A1 | 1/2015 | Bonfoey | |
| 2015/0135508 | A1* | 5/2015 | Ichimura | B21D 51/44 29/437 |
| 2015/0225107 | A1 | 8/2015 | Ross et al. | |
| 2015/0343516 | A1 | 12/2015 | Schremmer et al. | |
| 2015/0344166 | A1 | 12/2015 | Davis et al. | |
| 2015/0375888 | A1 | 12/2015 | Hosoi | |
| 2016/0052678 | A1 | 2/2016 | Hanafusa et al. | |
| 2016/0340088 | A1 | 11/2016 | Olson et al. | |
| 2017/0267415 | A1 | 9/2017 | Olson et al. | |
| 2017/0320637 | A1 | 11/2017 | Jones et al. | |
| 2018/0044155 | A1 | 2/2018 | Ross et al. | |

FOREIGN PATENT DOCUMENTS

| | | |
|---|---|---|
| CA | 1252649 | 4/1989 |
| CA | 2133312 | 7/1994 |
| CA | 2169743 | 2/1995 |
| CA | 2206483 | 9/1999 |
| CA | 2302557 | 9/2001 |
| CA | 2469238 | 6/2003 |
| CA | 2655925 | 1/2008 |
| CA | 2662199 | 3/2008 |
| CA | 2665477 | 5/2008 |
| CA | 2638403 | 10/2009 |
| CN | 1044925 | 8/1990 |
| CN | 1256671 | 6/2000 |
| CN | 1994826 | 7/2007 |
| CN | 101294255 | 10/2008 |
| CN | 100515875 | 7/2009 |
| CN | 101888907 | 11/2010 |
| CN | 101985707 | 3/2011 |
| DE | 6903478 | 5/1969 |
| DE | 2314662 | 10/1973 |
| DE | 3927491 | 2/1991 |
| DE | 4315111 | 11/1994 |
| DE | 60206036 | 6/2006 |
| DE | 102005010786 | 2/2007 |
| EP | 0721384 | 7/1996 |
| EP | 0740971 | 11/1996 |
| EP | 1136154 | 9/2001 |
| EP | 1531952 | 8/2006 |
| EP | 1731239 | 12/2006 |
| EP | 2119515 | 11/2009 |
| EP | 2146907 | 1/2010 |
| EP | 2531409 | 12/2012 |
| EP | 2646328 | 10/2013 |
| EP | 2662295 | 11/2013 |
| EP | 2662296 | 11/2013 |
| EP | 2835188 | 2/2015 |
| EP | 2955131 | 12/2015 |
| FR | 2775206 | 8/1999 |
| GB | 449861 | 7/1936 |
| GB | 971258 | 9/1964 |
| GB | 1215648 | 12/1970 |
| GB | 1598428 | 9/1981 |
| HU | 229285 | 10/2013 |
| JP | S61-163233 | 7/1986 |
| JP | S62-263954 | 11/1987 |
| JP | H07-211494 | 8/1995 |
| JP | H09-057384 | 3/1997 |
| JP | H10-203573 | 8/1998 |
| JP | H11-293363 | 10/1999 |
| JP | 2000-063973 | 2/2000 |
| JP | 2001-115226 | 4/2001 |
| JP | 2001-172728 | 6/2001 |
| JP | 2001-181768 | 7/2001 |
| JP | 2001-213416 | 8/2001 |
| JP | 2001-315745 | 11/2001 |
| JP | 2002-137032 | 5/2002 |
| JP | 2002-173717 | 6/2002 |
| JP | 2002-192272 | 7/2002 |
| JP | 2002-302137 | 10/2002 |
| JP | 2003-54687 | 2/2003 |
| JP | 2003-054687 | 2/2003 |
| JP | 2003-094133 | 4/2003 |
| JP | 3408213 | 5/2003 |
| JP | 2003-192093 | 7/2003 |
| JP | 2003-205924 | 7/2003 |
| JP | 2003-268460 | 9/2003 |
| JP | 2003-320432 | 11/2003 |
| JP | 2003-334631 | 11/2003 |
| JP | 2004-035036 | 2/2004 |
| JP | 2004-083128 | 3/2004 |
| JP | 2004-203462 | 7/2004 |
| JP | 2004-210403 | 7/2004 |
| JP | 2004-262488 | 9/2004 |
| JP | 2005-096843 | 4/2005 |
| JP | 2005-511418 | 4/2005 |
| JP | 3665002 | 4/2005 |
| JP | 2005-186164 | 7/2005 |
| JP | 2005-193272 | 7/2005 |
| JP | 2005-263230 | 9/2005 |
| JP | 2005-280768 | 10/2005 |
| JP | 2006-001619 | 1/2006 |
| JP | 2006-62755 | 3/2006 |
| JP | 2006-62756 | 3/2006 |
| JP | 3754076 | 3/2006 |
| JP | 2006-321541 | 11/2006 |
| JP | 3886329 | 2/2007 |
| JP | 2007-061881 | 3/2007 |
| JP | 2007-106621 | 4/2007 |
| JP | 2007-153363 | 6/2007 |
| JP | 2008-087071 | 4/2008 |
| JP | 4115133 | 4/2008 |
| JP | 4159956 | 7/2008 |
| JP | 4173388 | 8/2008 |
| JP | 4245916 | 1/2009 |
| JP | 2009-040461 | 2/2009 |
| JP | 2009-40461 | 2/2009 |
| JP | 2009108421 | 5/2009 |
| JP | 2010-018336 | 1/2010 |
| JP | 2010-202908 | 9/2010 |
| JP | 4553350 | 9/2010 |
| JP | 4564328 | 10/2010 |
| JP | 4646164 | 12/2010 |
| JP | 4723762 | 4/2011 |
| JP | 2011-116456 | 6/2011 |
| JP | 4757022 | 8/2011 |
| JP | 2011-208273 | 10/2011 |
| JP | 2011-526232 | 10/2011 |
| JP | 2012-192984 | 10/2012 |
| JP | 5290569 | 6/2013 |
| JP | 5323757 | 7/2013 |
| JP | 2013-244996 | 12/2013 |
| JP | 5597333 | 8/2014 |

(56) References Cited

FOREIGN PATENT DOCUMENTS

| | | |
|---|---|---|
| JP | 5855233 | 12/2015 |
| JP | 5857038 | 2/2016 |
| JP | 5887340 | 2/2016 |
| RU | 2221891 | 1/2004 |
| UA | 28415 | 12/2007 |
| WO | WO 92/04477 | 3/1992 |
| WO | WO 93/17864 | 9/1993 |
| WO | WO 94/20237 | 9/1994 |
| WO | WO 96/15865 | 5/1996 |
| WO | WO 96/28582 | 9/1996 |
| WO | WO 98/46488 | 10/1998 |
| WO | WO 99/32363 | 7/1999 |
| WO | WO 03/047991 | 6/2003 |
| WO | WO 03/057572 | 7/2003 |
| WO | WO 2004/018121 | 3/2004 |
| WO | WO 2004/094679 | 11/2004 |
| WO | WO 2007/030554 | 3/2007 |
| WO | WO 2008/089291 | 7/2008 |
| WO | WO 2009/091821 | 7/2009 |
| WO | WO 2009/115377 | 9/2009 |
| WO | WO 2010/117009 | 10/2010 |
| WO | WO 2011/059854 | 5/2011 |
| WO | WO 2011/078057 | 6/2011 |
| WO | WO 2011/147578 | 12/2011 |
| WO | WO 2012/133391 | 10/2012 |
| WO | WO 2012/144490 | 10/2012 |
| WO | WO 2013/167478 | 11/2013 |
| WO | WO 2013/167483 | 11/2013 |
| WO | WO 2014/168873 | 10/2014 |
| WO | WO 2015/054284 | 4/2015 |
| WO | WO 2017/134413 | 8/2017 |
| WO | WO 2017/191287 | 11/2017 |

OTHER PUBLICATIONS

"Ball Packaging Europe at drinktec 2013," Packaging Europe News Oct. 7, 2013, 2 pages [retrieved from: http://www.packagingeurope.com/Packaging-Europe-News/54154/Ball-Packaging-Europe-at-drinktec-2013.html].

"Electromagnetic forming," retrieved from http://en.wikipedia.org/wiki/Electromagnetic_forming, retrieved on Nov. 17, 2014, 4 pages.

"Impact Extrusion," Wikipedia, Dec. 9, 2009 retrieved from https://web.archive.org/web/20091209012819/http://en.wikipedia.org/wiki/Impact_extrusion, 5 pages.

"Screw thread," retrieved from http://en.wikipedia.org/wii/Screw_thread, retrieved on Jan. 8, 2015, 17 pages.

Cui et al. "Recycling of automotive aluminum," Transactions of Nonferrous Metals Society of China, Nov. 2010, vol. 20, No. 11, pp. 2057-2063.

Fisher et al. "Recycling—The Effect on Grain Refinement of Commercial Aluminum Alloys," London & Scandinavian Metallurgical Co Limited, 122nd TMS Annual Meeting & Exhibition, Feb. 21-25, 1993, 6 pages.

Goltz "Aluminum Bottles are Successful," University of Wisconsin, 2005, 5 pages [retrieved from: http://www2.uwstout.edu/content/rs/2005/article6.pdf].

Guley et al. "Direct recycling of 1050 aluminum alloy scrap material mixed with 6060 aluminum alloy chips by hot extrusion," International Journal of Material Forming, Apr. 2010, vol. 3, No. Suppl. 1, pp. 853-856.

Herbert, "Manufacturing Processes," Prentice-Hall, Inc., Englewood Cliffs, NJ, excerpts from pp. 548-553, 562-563, 1979, 11 pages.

Tekkaya et al. "Hot profile extrusion of AA-6060 aluminum chips," Journal of Materials Processing Technology, Apr. 2009, vol. 209, No. 7, pp. 3343-3350.

International Search Report and Written Opinion for International (PCT) Patent Application No. PCT/US2018/018216, dated May 2, 2018 9 pages.

International Preliminary Report on Patentability for International (PCT) Patent Application No. PCT/US2018/018216, dated Aug. 29, 2019 8 pages.

* cited by examiner

APPARATUS AND METHODS OF FORMING AND APPLYING ROLL-ON PILFER PROOF CLOSURES ON THE THREADED NECK OF METAL CONTAINERS

CROSS-REFERENCE TO RELATED APPLICATIONS

This application claims priority under 35 U.S.C. § 119(e) to U.S. Provisional Patent Application Ser. No. 62/459,687, filed Feb. 16, 2017, and to U.S. Provisional Patent Application Ser. No. 62/527,760, filed Jun. 30, 2017, which are each incorporated herein in their entirety by reference.

FIELD OF THE INVENTION

The present invention relates generally to the manufacture and sealing of containers. More specifically, this invention provides apparatus and methods used to seal containers with Roll-on Pilfer Proof (ROPP) closures after the container is filled with a product, such as a beverage.

BACKGROUND

Modern containers are used to store a variety of products including beverages and food products. There are a variety of shapes utilized depending on the application. Some containers, such as beverage containers, have a bottle shape. Bottle shaped containers typically include a closed bottom portion, a generally cylindrical body portion, a neck portion with a reduced diameter extending upwardly from the body portion, and an opening positioned on an uppermost portion of the neck portion opposite to the closed bottom portion. Bottles may be formed from a variety of materials, including plastic, glass, and more commonly metal (including tin coated steel and aluminum).

After being filled with a beverage or other product, bottles are typically sealed with a roll-on-pilfer proof closure (ROPP) that may be used to re-close the bottle. However, other closures, such as twist-off crown caps, can also be used to seal bottles. ROPP closures frequently include a tamper indicator or pilfer band releasably interconnected to a body of the ROPP closure. The pilfer band is adapted to separate from the closure body when the ROPP closure is at least partially rotated in an opening direction. When the ROPP closure is removed from the bottle, the pilfer band is retained on the neck of the bottle. In this manner, the pilfer band provides a visual indication to the consumer that the bottle has been at least partially opened or that someone has tampered with the bottle. Methods and apparatus of forming a threaded neck to receive a ROPP closure on a bottle formed of metal are generally described in U.S. Patent Application Publication No. 2014/0263150 which is incorporated herein by reference in its entirety.

Referring now to FIGS. 1A-1F, several prior art steps are depicted during capping of a prior art bottle 2 to generate and maintain an effective seal between the bottle 2 and a ROPP closure 10. As shown in FIGS. 1A-1B, a ROPP shell 10 with an unthreaded body portion 12A is placed on the neck portion 4 of the bottle 2. A bottom portion of the ROPP shell 10 forms a pilfer band 18 that is releasably interconnected to the ROPP shell 10 by a serrated band 17. The ROPP closure 10 covers the bottle threads 8 with the pilfer band 18 extending downward past a skirt 30 of the bottle 2.

Referring now to FIG. 1C, a capping apparatus 22 subsequently performs three operations, including: (1) reforming the top portion 20 of the ROPP closure 10 to form a reform or channel 32; (2) forming threads 16 on a portion of the closure body 12; and (3) tucking the pilfer band 18 against the skirt 30 of the bottle 2. The timing and sequence of these three actions may vary between different prior art capping apparatus 22. Generally, one or more of a pressure block ejector 24 and a pressure block 25 apply a "top load" to a top portion 20 of the ROPP closure 10 to press an outer edge of the top portion 20 down around a curl 6 of the bottle 2 creating a reform or channel 32 in the ROPP closure. An interior surface of the channel 32 applies force to a liner 14 within the ROPP closure 10. Accordingly, the liner 14 contacts an exterior of the bottle curl 6 to form an effective seal.

Once sealed, closure threads 16 are formed on the ROPP closure 10 to maintain the seal once the pressure block ejector 24 and the pressure block 25 are removed. The closure threads 16 are formed by a thread roller 26 that applies a "side-load" to the body 12 of the ROPP closure 10. Typically, two thread rollers 26 are used. The thread rollers 26 use the underlying bottle threads 8 as a mandrel. The closure threads 16 are formed as the thread rollers 26 press against and wind down the body 12 of the ROPP closure 10 along the bottle threads 8.

Two pilfer rollers 28 press inwardly against the bottle 2 to tuck the bottom edge of the ROPP closure 10 against a protrusion, known as the skirt 30, of the bottle 2. The pilfer rollers 28 also apply a side-load to the bottle 2 to tuck the pilfer band 18 against the bottle skirt 30. Some pilfer rollers 28 may contact a portion of the bottle 2 neck while tucking the pilfer band 18. The pilfer band 18 is typically rolled inwardly at about a 45° angle on the neck 4 of the bottle 2. A lowermost portion 19 of the pilfer band 18 is typically oriented inwardly toward a longitudinal axis of the bottle 2. In this manner, if the ROPP closure 10 is rotated in an opening direction, the serrated band 17 is severed and the pilfer band 18 is retained on the bottle neck portion 4 to provide visual evidence of tampering.

An example of a neck portion 4 of a metallic bottle 2 sealed by a ROPP closure 10 is illustrated in FIG. 1D. An expanded view of a portion of another embodiment of a prior art metallic bottle 2A is illustrated in FIG. 1E. The metallic bottle 2A is also shown sealed by another prior art ROPP closure 10A in FIG. 1F.

There are several problems associated with current ROPP closures 10 as well as the methods used to seal them to a bottle 2. First, the bottom edge 19 of the pilfer band 18 may flare outwardly generating a cutting hazard. Further, when the serrated band 17 is severed, the pilfer band 18 may slide downwardly away from the bottle skirt 30 exposing the edge of the serrated band 17 and creating another potential cutting hazard.

In addition, when the bottle 2 is sealed with a ROPP closure 10, the pilfer rollers 28 must push against the bottle 2 to tuck the pilfer band 18 against bottle skirt 30. By pressing against the bottle 2, the pilfer rollers 28 may exert an excessive force which can distort the shape of the bottle 2 and create failure. For example, a cross-sectional shape of the neck portion 4 of the metallic bottle 2 may be deformed from a preferred generally circular shape to a non-circular shape such as an oval or an ellipse by the pilfer rollers. The side-load force of the pilfer rollers 28 must be accounted for when forming the bottle 2 by strengthening the bottle 2. This frequently results in forming the bottle with a thicker material than would be required by a similar bottle 2, thus increasing cost. Metallic bottles 2 formed of aluminum may be sealed with ROPP closures 10 using a cumulative load to about 380 pounds. Although less than the cumulative load applied to glass bottles sealed with ROPP closures, these loads may be excessive for some current metallic bottles 2. Accordingly, there is only a small production window that is useful for capping known metallic bottles 2 with prior art ROPP closures 10 and methods. The small production window results in overstress and failures of the metallic bottle 2 or the ROPP closure 10 when the capping apparatus 22 is out of calibration or for marginal metallic bottles 2. Further, because the nominal loads applied by the prior art processes and capping apparatus 22 are close to the maximum amount that the metallic bottle 2 can withstand, it is not possible produce a lightweight metallic bottle that can be sealed with a prior art ROPP closure 10 using the prior art processes and capping apparatus 22. Accordingly, the side-load force applied by the pilfer rollers 28 pressing against the prior art metallic bottle 2 prevents a reduction in the thickness of the metallic bottle 2 (known as "light-weighting") to form a lighter metallic bottle 2 with a reduced amount of material. Methods and apparatus to seal light-weight metallic bottles are described in applicant's co-pending applications U.S. patent application Ser. No. 15/236,174, filed Aug. 12, 2016 and entitled "Apparatus and Methods of Capping Metallic Bottles," and PCT App. No. PCT/US17/46026, filed Aug. 9, 2017 which are incorporated herein by reference in their entirety.

Another problem with the current method of sealing a bottle 2 with a ROPP closure 10 is that the pilfer rollers 28 may also form an unintended groove (not illustrated) in the bottle neck 4. The groove may decrease the height of the bottle 2 and cause a defective (or less effective) seal between the bottle 2 and the ROPP closure 10.

Yet another problem with the current ROPP closures 10 is that the pilfer band 18 must be tucked against a skirt portion 30 formed in the neck 4 of the bottle 2. Forming the skirt portion 30 in the bottle 2 requires die necking the bottle neck 4 inwardly one or more times. The diameter of the neck portion 4 may also be expanded outwardly one or more times when forming the skirt portion 30. As will be appreciated by one of skill in the art, each forming operation is performed by a different apparatus which must be calibrated and maintained. Each forming operation also can damage the bottle 2 if an apparatus is defective or out of calibration. There is also a significant tooling expense and a large production space requirement associated with forming the skirt portion 30, thus increasing the production time and associated cost of the bottle 2. These metal shaping procedures may also lead to over-working and excessively weakening the bottle 2 and splitting of the bottle curl 6.

Due to the limitations and shortcomings associated with current ROPP closure designs, there is an unmet need for a ROPP closure that may be used to seal a bottle without pressing against the bottle and that may be used to seal a bottle formed with a thinner body and less material (hereinafter a "light-weight" bottle) as well as a bottle that does not require a skirt portion to retain a pilfer band of a ROPP closure.

SUMMARY OF THE INVENTION

The present invention provides a ROPP closure and a bottle that are novel. The bottle includes an annular ring. The annular ring can be formed on the bottle instead of, or in addition to, a skirt portion. The ROPP closure can be sealed to a bottle without pressing against the bottle. More specifically, a portion of the ROPP closure is pressed at least partially into the annular ring.

One aspect of the present invention is a ROPP closure with a novel pilfer band. The pilfer band is releasably interconnected to the ROPP closure by an area of weakness. The area of weakness is designed to fracture or tear in response to a predetermined amount of force when the ROPP closure is rotated. In one embodiment, the area of weakness comprises a serrated band. The serrated band may include a plurality of apertures formed through the ROPP closure such that the pilfer band is interconnected to the ROPP closure by bridges between adjacent apertures. In another embodiment, the area of weakness comprises a score adapted to facture in response to rotation of the ROPP closure.

In one embodiment, when sealed to a bottle, the pilfer band includes an upper portion proximate to the serrated band, a medial portion, and a lower portion that is located proximate to a lowermost portion of the pilfer band. The medial portion of the pilfer band is adapted to be pressed at least partially into a groove or annular ring of a bottle. The lowermost portion of the pilfer band extends below the annular ring of the bottle.

Optionally, the upper and lower portions are generally cylindrical. The upper and lower portions of the pilfer band may also have cross-sections that are substantially linear. In one embodiment, the upper portion has a first diameter that is substantially uniform. In another embodiment, the lower portion has a second diameter than is substantially uniform. Optionally, the second diameter is approximately equal to the first diameter. In one embodiment, the upper and lower portions are generally parallel. More specifically, the upper and lower portions can have diameters that are substantially equal.

In one embodiment, when the ROPP closure is sealed to a bottle, an inwardly oriented protrusion is formed in the medial portion of the ROPP pilfer band. The inwardly oriented protrusion is aligned with the annular ring of the bottle. The inwardly oriented protrusion can have a substantially uniform cross-sectional profile. In this embodiment, the inwardly oriented protrusion optionally has a depth that is generally uniform around a circumference of the pilfer band. In one embodiment, the inwardly oriented protrusion of the ROPP closure engages an upper portion of the bottle annular ring when the ROPP closure is rotated to open the bottle. In this manner, the upper portion of the annular ring receives a force from the ROPP pilfer band. The force is sufficient to fracture a serrated band or score of the ROPP closure to separate the pilfer band from the ROPP closure.

Alternatively, in another embodiment, the medial portion of the ROPP pilfer band includes the plurality of studs formed after the ROPP closure is positioned on a bottle. In one embodiment, the plurality of studs are not continuous around the circumference of the pilfer band. More specifically, in one embodiment, the plurality of studs comprise individual indentations that extend inwardly at least partially into an annular ring of the bottle. When the ROPP closure is rotated to open the bottle, the studs of the pilfer band engage an upper portion of the annular ring. In this manner, the upper portion of the annular ring receives a force from one or more of the studs. The force is sufficient to fracture the serrated band of the ROPP closure.

The studs have a size and shape to selectively engage the annular ring. In one embodiment, the studs have a size and shape designed to reduce the likelihood of damage or deformation to the bottle neck as a result of excessive force applied to the bottle by one or more of the studs. Optionally, the number of studs formed in the pilfer band is selected to provide enough force to fracture the serrated band when the ROPP closure is rotated in an opening direction without applying an excessive force to the upper portion of the annular ring.

In one embodiment, the ROPP closure includes a body portion with an increased length compared to known ROPP closures. Additionally, or alternatively, in one embodiment the pilfer band of the ROPP closure has an increased length compared to known pilfer bands.

Another aspect of the present invention is a bottle with a pilfer groove or annular ring. The annular ring has a predetermined geometry including a depth sufficient to receive an inwardly oriented protrusion or a plurality of studs formed on a pilfer band of a ROPP closure. The annular ring includes an upper portion configured to receive a force from the pilfer band of the ROPP closure when the ROPP closure is rotated in an opening direction. The force is sufficient to fracture a serrated band of the ROPP closure such that the pilfer band separates from the ROPP closure and is retained on the neck portion of the bottle. In one embodiment, the bottle is formed of one of metal, plastic, and glass. In another embodiment, the bottle is formed metal.

The annular ring may be formed on the bottle by spin shaping a neck portion of the metallic bottle. In one embodiment, the annular ring is formed without expanding the neck portion outwardly or die necking the neck portion inwardly. Optionally, the annular ring can be formed by necking and expanding the neck portion with dies.

In one embodiment, the annular ring is optionally formed on the bottle in a single operation by a roller. More specifically, the annular ring can be formed by a threading apparatus in conjunction with the forming threads on the bottle. In one embodiment, the threading apparatus includes an inner tool and an outer tool, such as illustrated in U.S. Patent Application Publication No. 2014/0263150. The inner and outer tools come together and squeeze the neck portion of the bottle therebetween.

In one embodiment, the outer tool pushes against, and applies a force to, a predetermined portion of the bottle neck portion. The outer tool contacts the neck portion at a planned centerline of the annular ring. In another embodiment, the inner tool contacts and supports an interior surface portion of the neck portion at an upper point spaced axially above the planned centerline. Additionally, or alternatively, the inner tool can optionally contact the interior surface portion at a lower point spaced axially below the planned centerline of the annular ring. The inner and outer tools may be rotated around a longitudinal axis of the bottle. As the tools are rotated around the bottle, the shape of the bottle threads and the annular ring are embossed on the bottle.

In one embodiment, the bottle is pinched between the inner and outer tools proximate to the upper and lower points. Accordingly, a diameter of the neck portion is substantially uniform at the upper and lower points. The annular ring has a decreased diameter compared to the diameter of the neck portion at the upper and lower points.

In another embodiment, the annular ring is formed by a forming apparatus before, or after, the bottle threads are formed. More specifically, the bottle is spun along its longitudinal axis. An exterior tool of the forming apparatus contacts an exterior surface portion of the neck portion to form the annular ring. In one embodiment, the exterior tool contacts the bottle neck portion proximate to a planned centerline of the annular ring. Optionally, an interior tool may be positioned within an interior of the metallic bottle. The interior tool provides support to one or more of an upper point and a lower point spaced from the planned centerline.

It is another aspect of the present invention to provide a ROPP closure with a pilfer band configured to engage an annular groove or ring formed in a neck portion of a bottle. In one embodiment, the pilfer band has a cross-sectional shape similar to the cross-sectional shape of the annular ring. In this manner, incidental or unintended movement of the pilfer band, such as wobbling which can cause a hinge or diagonal tipping of the pilfer band, is decreased compared to pilfer bands of known ROPP closures.

In one embodiment, the pilfer band of the present invention has an increased strength and resists expansion and hinging better than know ROPP closures. Known ROPP closures have only one lower edge that is tucked against a skirt of a bottle such that only one thickness of ROPP closure material must be expanded to have the pilfer band slide upwards on the bottle. Accordingly, some prior art ROPP closures can be removed from a bottle without detaching an associated pilfer band due to deformation of the pilfer band. In contrast, the ROPP closure of the present invention provides two thickness of ROPP closure material, an upper portion and a lower portion, which are tucked into the bottle annular ring.

Yet another aspect of the present invention is a bottle sealed by a ROPP closure of the present invention. The bottle includes a circumferential groove or annular ring. In one embodiment, the annular ring has a decreased depth compared to the skirt of current bottles. A pilfer band of the ROPP closure is tucked at least partially into the annular ring. A portion of the pilfer band extends downwardly beyond a lowermost portion of the bottle annular ring.

Optionally, in one embodiment, a pilfer roller tucks a portion of the pilfer band into the annular ring to form an inwardly oriented protrusion in the pilfer band. In this manner, the pilfer roller does not press against the bottle.

In one embodiment, the ROPP closure includes a body portion with an increased length compared to known ROPP closures. Additionally, or alternatively, the pilfer band of the ROPP closure may have an increased length compared to known pilfer bands. In this manner, the protrusion extends into, and back out of, the annular ring.

In another embodiment, a tool forms a plurality of individual studs in a portion of the pilfer band. The studs extend at least partially into the annular ring of the bottle. Each stud, in one embodiment, is separately formed such that two adjacent studs are spaced from each other. In one embodiment, the studs are each separated by a non-deformed portion of the pilfer band. In another embodiment, each stud is spaced from a lowermost portion of the pilfer band by a non-deformed portion of the pilfer band. The individual studs can be formed by one or more of a punch, a stud roller, a studded rail, a collet actuated tool, and cam actuated tool of embodiments of the present invention. In one embodiment, the studs are formed by a capping apparatus that is operable to form the closure threads. Alternatively, the studs are formed by an apparatus downstream from a capping apparatus that forms closures threads on the ROPP closure.

In one embodiment, the bottle is formed of one of a metal, a plastic, and a glass. In one embodiment, the bottle is formed of a metal such as tin coated steel or aluminum. In another embodiment, the bottle is a light-weight metallic bottle comprising less metallic material and less mass than known metallic bottles sealed with ROPP closures. In one embodiment, the metallic bottle comprises a decreased gauge than prior art metallic bottles of substantially the same size and shape.

In one embodiment, the bottle is configured to store a pressurized product with a maximum internal pressure of up to about 100 pounds per square inch without unintended venting of product from the bottle. In yet another embodiment, the maximum internal pressure is up to about 135 pounds per square inch without failure or blow-off of the ROPP closure.

Another aspect of the present invention is a novel method and apparatus of capping a bottle having a novel annual ring with a novel ROPP closure. In one embodiment, the capping apparatus includes at least one pilfer roller. The pilfer roller presses a portion of a pilfer band of the ROPP closure into the annular ring of the bottle to form an inwardly oriented protrusion. When forming the protrusion, the pilfer roller, in one embodiment, does not press against the bottle. The pilfer roller does not contact the bottle. More specifically, the pilfer roller works against the closure without applying a force to the bottle. In this manner, the capping apparatus may be used to seal a bottle formed of metal that has a decreased gauge compared to known metallic bottles.

In another embodiment, the capping apparatus includes a stud forming tool. The stud forming tool forms a plurality of non-continuous studs or indentations in the pilfer band. The studs extend inwardly at least partially into the bottle annular ring. In this manner, the studs retain the pilfer band on the neck of the bottle. Each stud formed by the stud forming tool extends at least a predetermined distance into the annular groove of the bottle. When forming the studs, the stud forming tool, in one embodiment, does not press against, or contact, the bottle and thus prevents damage to the neck of the bottle. In one embodiment, the stud forming tool comprises one of: (1) a punch; (2) a stud roller; (3) a studded rail, and (4) a tool with a plurality of individual punches. The punch, stud roller, studded rail, and tool with a plurality of individual punches each include at least one punch. The punches of the tool with a plurality of individual punches can be actuated by one of a collet and a cam.

In one embodiment, the punch has a diameter of up to approximately 0.1 inch. In another embodiment, the punch diameter is between about 0.04 inches and about 0.08 inches. The punches have a predetermined length which, in one embodiment, is less than about 0.1 inch. In another embodiment, the length is greater than about 0.04 inches. In another embodiment, the punch length is between about 0.05 inches and about 0.09 inches. Optionally, a tip of the punch is generally spherical. The tip of the punch applies a force to the pilfer band to form a stud. In another embodiment, the studs formed by the punch have a depth of up to approximately 0.03 inches. In another embodiment, the depth of the studs formed by a punch is between approximately 0.02 inches and approximately 0.03 inches. In another embodiment, the depth is up to about 0.04 inches. In one embodiment, the stud depth is between about 0.025 inches and about 0.1 inch. In another embodiment, the stud depth is approximately half-way between an exterior diameter of the pilfer band and an interior diameter of the bottle annular ring.

Studs formed by the punch have a predetermined width and height. Optionally, at least one of the width and height are less than about 0.2 inches. In another embodiment, the width and height are less than about 0.1 inch. In another embodiment, the width and height are at least about 0.03 inches. In one embodiment, the width and height are greater than about 0.05 inches. Optionally, one or more of the width and height are between about 0.03 inches and about 0.2 inches. In another embodiment, the width and height are between about 0.05 inches and about 0.17 inches. In one embodiment, the width and height are substantially equal.

In another embodiment, the stud roller comprises a shaft and a head. The stud roller is configured to rotate around a longitudinal axis of the shaft. When forming studs on a pilfer band of a ROPP closure, the stud roller moves around a circumference of the ROPP closure which is positioned on the bottle. In one embodiment, the head of the stud roller has a shape that is generally circular. A plurality of punches extend from the head. In one embodiment, the punches extend approximately radially from the head. Accordingly, as the stud roller moves around the circumference of the ROPP closure, individual punches rotate into contact with the pilfer band to form the studs in the pilfer band.

In one embodiment, the studded rail includes a body. A plurality of punches extend from a first side of the body. In one embodiment, the first side of the body has a concave shape. More specifically, the first side of the body may have an arcuate shape with a generally uniform radius of curvature. Optionally, the punches extend from the first side generally parallel to a radius of the radius of curvature.

In operation, after a ROPP closure is placed on a bottle, a capping apparatus forms threads on the ROPP closure. The capped bottle is then moved to the studded rail and the ROPP closure is moved into contact with one or more of the punches of the studded rail. In one embodiment, the studded rail is substantially stationary. The bottle and the ROPP closure rotate around a longitudinal axis of the bottle such that as the ROPP closure rotates, successive punches contact the pilfer band to form individual studs in the pilfer band. The studs extend a predetermine distance into the annular ring of the bottle.

In one embodiment, the tool with the plurality of individual punches has a generally circular cross section. Each punch includes a free end facing inwardly. Optionally, the punches are generally aligned with radii of the tool. The free ends of the punches define a void or chamber with an interior diameter at least equal to an exterior diameter of the pilfer band. In operation, the individual punches of the tool contact the pilfer band to form a plurality of studs in the pilfer band.

In one embodiment, the punches can move individually. More specifically, in one embodiment, the punches can move inwardly toward the ROPP closure. Optionally, each of the punches is configured to pivot inwardly. In another embodiment, the punches move inwardly generally parallel to a radius of a ROPP closure positioned within the chamber of the tool. As the punches move individually, the free end of each punch moves inwardly toward a center of the circular cross-section of the tool. Optionally, the punches pivot inwardly in response to a force received from a collet. More specifically, in one embodiment, the movement of the punches is actuated by a collet.

In another embodiment, the tool includes punches which are actuated by a cam. The tool includes a central chamber defined by an interior surface. A plurality of punches extend into the central chamber beyond the interior surface of the tool. A free end of each punch faces inwardly toward a center of the tool. In operation, a cam applies a force to the tool and, in response, successive punches move inwardly to contact the pilfer band. In one embodiment, the cam has a shape that is eccentric. Alternatively, the cam shape is generally circular. In another embodiment, the interior surface of the tool has a shape that is not circular or is elliptical. Optionally, the tool includes a plurality of segments. Each segment includes a punch. In one embodiment, both a segment and an associated punch move inwardly in response to a force from the cam. Alternatively, in another embodiment, each punch is movable with respect to an associated segment. Accordingly, only the punch moves in response to a force from the cam while the associated segment remains substantially stationary. In still another embodiment, the tool includes a body with an interior surface defining the central chamber. The punches extend through the body such that distal ends of the punches selectively extend beyond the interior surface into the chamber. The punches move inwardly into the chamber in response to a force received from the cam.

One aspect of the present invention is to provide a threaded container adapted to receive a roll-on pilfer proof (ROPP) closure. The threaded container generally includes, but is not limited to, one or more of: (1) a closed end portion; (2) a body portion extending upwardly from the closed end portion; (3) a neck extending upwardly from the body portion; (4) an annular ring formed in the neck, the annular ring adapted to receive and retain a portion of the roll-on pilfer proof closure; (5) threads formed on at least a portion of the neck; and (6) an opening positioned on an uppermost portion of the neck. In one embodiment, the threaded container is formed of one of a plastic, a metal, and a glass. In another embodiment, the threaded container is formed of a metal. In still another embodiment, the threaded container is formed of one of aluminum and tin coated steel. The annular ring is spaced axially from a lowermost portion of the threads by a predetermined distance. Optionally, the predetermined distance between the annular ring and the lowermost portion of the threads is at least about 0.05 inches. In another embodiment, the predetermined distance is less than about 0.5 inches. In another embodiment, the predetermined distance between the annular ring and the thread lowermost portion is between about 0.05 inches and about 0.5 inches. In one embodiment, the annular ring is formed in the neck below the threads. More specifically, in one embodiment, the annular ring is formed between the threads and the body portion of the threaded container.

In one embodiment, the annular ring is spun onto the threaded container. In another embodiment, the annular ring is formed without one or more of die necking the neck inwardly and expanding the neck outwardly. Optionally, the annular ring is positioned between a lowermost portion of the threads and the body portion. Additionally, or alternatively, a portion of the neck above the annular ring and a portion of the neck below the annular ring have diameters that are substantially equal. In another embodiment, an upper neck portion above the annular ring is substantially concentric to a lower neck portion below the annular ring.

In one embodiment, the annular ring has a depth of at least about 0.03 inches. In another embodiment, the depth is at least about 0.045 inches. In another embodiment, the depth is at least about 0.05 inches. Optionally, the depth of the annular ring is related to a diameter of the neck portion of the threaded container. Accordingly, for a threaded container with a first diameter the depth is at least about 0.04 inches and for a second threaded container with a second diameter, the depth is at least about 0.05 inches. In another embodiment, the depth is between about 0.3 inches and about 0.1 inch. In one embodiment, the annular ring has a height of between approximately 0.025 inches and approximately 0.2 inches.

In another embodiment, the annular ring has a cross-sectional geometric profile. In one embodiment, the cross-sectional geometric profile of the annular ring is at least one of a U-shape, a V-shape, and an open box with three sides. In another embodiment, the three sides of the open box are generally perpendicular.

In one embodiment, the threaded container is sealed by a ROPP closure. The ROPP closure generally includes one or more of: (a) a closed end-wall; (b) a body portion extending downwardly from the closed end-wall; (c) closure threads formed in a portion of the body portion; (d) a pilfer band releasably interconnected to the body portion; and (e) at least one of an inwardly oriented protrusion and a plurality of studs or indentations extending at least partially into the annular ring of the threaded container. In one embodiment, the inwardly oriented protrusion extends around the circumference of the pilfer band. Optionally, the inwardly oriented protrusion has a substantially uniform depth. Alternatively, in another embodiment, the plurality of studs are separated from each other by a non-deformed portion of the pilfer band. The plurality of studs are oriented inwardly into the annular ring of the threaded container.

Optionally, the pilfer band of the ROPP closure further comprises: (i) an upper portion proximate to the closure threads; (ii) a medial portion; and (iii) a lower portion located proximate to the closed end portion of the threaded bottle. In one embodiment, the medial portion includes the inwardly oriented protrusion. Alternatively, in another embodiment, the medial portion includes the plurality of studs. In one embodiment, the lower portion of the pilfer band is generally parallel to the upper portion of the pilfer band. Optionally, the lower portion of the pilfer band is substantially concentric to the upper portion of the pilfer band. In another embodiment, the lower portion has an interior diameter that is about equal to an interior diameter of the upper portion. The pilfer ban can optionally be releasably interconnected to the body portion by at least one of a serrated band and a score. In one embodiment, the lower portion of the ROPP closure extends below a lowermost portion of the annular ring.

In one embodiment, the inwardly oriented protrusion is formed by a pilfer roller when the threaded container is sealed with the ROPP closure. Alternatively, the plurality of studs are formed by a stud forming tool. Optionally, the stud forming tool comprises one of: (1) a punch; (2) a stud roller; (3) a studded rail; and (4) a tool with a plurality of individual punches. In one embodiment, the plurality of studs are formed by a capping apparatus which is configured to form the closure threads on the ROPP closure. Alternatively, the plurality of studs are formed by a tool that receives the threaded container capped by the ROPP closure.

It is another aspect of the present invention to provide a method of retaining a roll-on pilfer proof (ROPP) closure on a threaded bottle. The method generally comprises: (1) providing the threaded bottle, comprising one or more of: (a) a closed end portion; (b) a body portion extending upwardly from the closed end portion; (c) a neck extending upwardly from the body portion; (d) an annular ring formed in the neck; (e) threads formed on at least a portion of the neck; and (f) an opening positioned on an uppermost portion of the neck; (2) positioning the ROPP closure on the neck of the threaded bottle; (3) applying a downward oriented force to a closed end-wall of ROPP closure; (4) forming threads in a portion of the ROPP closure; and (5) pressing at least a portion of the ROPP closure at least partially into the annular ring of the threaded bottle. In this manner, the ROPP closure is retained on the threaded bottle to prevent unintended travel in a direction substantially parallel to the longitudinal axis of the threaded bottle. In one embodiment, the pilfer band cannot be removed from the threaded bottle after the portion of the ROPP closure is pressed into the annular ring. Optionally, the threaded bottle is formed of one of a plastic, a metal, and a glass. In another embodiment, the threaded bottle is formed of a metal. In another embodiment, the threaded bottle is formed of one of aluminum and tin coated steel. Optionally, the annular ring can have a depth of at least about 0.03 inches. In another embodiment, the annular ring has a depth of at least about 0.04 inches. In another embodiment, the depth is between about 0.025 inches and about 0.2 inches.

In one embodiment, pressing at least a portion of the ROPP closure at least partially into the annular ring comprises pressing a portion of a pilfer band of the ROPP closure into the annular ring of the threaded bottle. Optionally, pressing the pilfer band inwardly comprises forming an inwardly oriented protrusion extending around a circumference of the pilfer band. In one embodiment, the inwardly oriented protrusion is formed by a roller which applies a force to the portion of the pilfer band. In one embodiment, the roller is a thread roller of a capping apparatus. Alternatively, pressing a portion of the pilfer band inwardly comprises forming a plurality of individual studs in the pilfer band. In one embodiment, the plurality of individual studs are formed by a tool with at least one punch. Optionally, the tool is a stud roller. In one embodiment, the stud roller is associated with a capping apparatus. In another embodiment, the tool is a studded rail. The studded rail can be positioned downstream from a capping apparatus. In still another embodiment, the tool comprises a plurality of punches. The plurality of punches can move from a disengaged position to an engaged position. In one embodiment, the plurality of punches of the tool move to the engaged position in response to a force received from a collet. In another embodiment, the plurality of punches of the tool move to the engaged position in response to a force received from a cam.

In one embodiment, the portion of the pilfer band pressed into the annular ring of the threaded bottle has a depth of between about 0.02 inches and about 0.1 inch. In another embodiment, the depth of the pilfer band portion pressed into the bottle annular ring is approximately half-way between an exterior diameter of the pilfer band and an interior diameter of the bottle annular ring. Optionally, the portion of the pilfer band pressed into the annular ring has a height of between about 0.06 inches and about 0.2 inches.

In one embodiment, the ROPP closure generally includes: (a) a closed end-wall; (b) a body portion extending downwardly from the closed end-wall; (c) closure threads formed in a portion of the body portion; (d) the pilfer band releasably interconnected to the body portion; and (e) at least one of an inwardly oriented protrusion and a plurality of studs extending at least partially into the annular ring of the threaded bottle. Optionally, the pilfer band of the ROPP closure further comprises: (i) an upper portion releasably interconnected to the body portion of the ROPP closure; (ii) a medial portion; and (iii) a lower portion located proximate to the closed end portion of the threaded bottle. In one embodiment, the medial portion includes the inwardly oriented protrusion. Alternatively, in another embodiment, the medial portion includes the plurality of studs. In one embodiment, the lower portion of the pilfer band is generally parallel to the upper portion of the pilfer band. Optionally, the lower portion of the pilfer band is substantially concentric to the upper portion of the pilfer band. In another embodiment, the lower portion has an interior diameter that is about equal to an interior diameter of the upper portion. The pilfer ban can optionally be releasably interconnected to the body portion by at least one of a serrated band and a score.

In one embodiment, the inwardly oriented protrusion is formed by a pilfer roller when the threaded bottle is sealed with the ROPP closure. The pilfer roller forms the inwardly oriented protrusion which extends around the circumference of the pilfer band.

In another embodiment, the plurality of studs are formed by a stud forming tool. The stud forming tool may include, but is not limited to, at least one of (1) a punch; (2) a stud roller; (3) a studded rail; and (4) a tool with a plurality of individual punches. The plurality of studs are separately formed. More specifically, a first stud is separated from two adjacent studs by a portion of the ROPP closure. In another embodiment, each inwardly oriented stud is spaced from a lowermost edge of the pilfer band by a non-deformed portion of the pilfer band.

Yet another aspect of the present invention is a threaded bottle adapted to be sealed by a ROPP closure. The threaded bottle generally comprises, but is not limited to: (1) a closed end portion; (2) a body portion extending upwardly from the closed end portion; (3) a neck extending upwardly from the body portion; (4) threads formed on at least a portion of the neck; (5) an opening positioned on an uppermost portion of the neck; and (6) an annular ring formed in the neck, the annular ring configured to receive a portion of a pilfer band of the ROPP closure. In one embodiment, the annular ring has a substantially U-shaped cross-sectional profile. Optionally, the annular ring has a depth of at least about 0.04 inches. In one embodiment, the annular ring depth is between about 0.025 inches and about 0.2 inches. The threaded bottle is optionally formed of one of: a metal, a glass, and a plastic.

In one embodiment, the threaded bottle further comprises the ROPP closure positioned on the neck. In one embodiment, the ROPP closure includes one or more of: (A) closure threads engaging the threads of the threaded bottle; (B) the pilfer band severably interconnected to the ROPP closure; and (C) a plurality of studs formed in the pilfer band, each of the studs extending inwardly into the annual ring such that the ROPP closure cannot be disengaged from the neck of the threaded bottle without severing the pilfer band at least partially from the ROPP closure. In one embodiment, the pilfer ban is severably interconnected to the ROPP closure by one or more of a serrated band and a score. Optionally, the studs have a depth which is approximately equal to one half of the difference between an exterior diameter of the pilfer band and an interior diameter of the bottle annular ring. In one embodiment, the stud depth is between about 0.02 inches and about 0.1 inches. In another embodiment, the studs have a height of between about 0.06 inches and about 0.2 inches.

In one embodiment, adjacent studs are separated from one another by a non-deformed portion of the pilfer band. In another embodiment, the studs are separated from a lowermost edge of the ROPP closure by a non-deformed portion of the pilfer band. Optionally, the studs are generally centered vertically on the pilfer band.

Still another aspect of the present invention is to provide threaded bottle sealed by a ROPP closure. The threaded bottle generally includes, but is not limited to, one or more of: (1) a closed end-wall; (2) a sidewall extending upwardly from the closed end-wall; (3) a neck extending upwardly from the sidewall; (4) threads formed on at least a portion of the neck; (5) an annular ring formed in the neck below the threads; (6) an opening positioned on an uppermost portion of the neck; and (7) the ROPP closure positioned on the neck. Optionally, the annular ring has a depth of at least about 0.04 inches. In another embodiment, the depth of the annular ring is between about 0.025 inches and about 0.2 inches. In one embodiment, the annular ring has a substantially U-shaped cross-sectional profile.

The ROPP closure generally includes one or more of: (A) closure threads engaging the bottle threads; (B) a pilfer band severably interconnected to the ROPP closure; and (C) at least one protrusion formed in the pilfer band, the protrusion extending inwardly into the annual ring, wherein the ROPP closure cannot be disengaged from the neck of the threaded bottle without severing the pilfer band at least partially from the ROPP closure. In one embodiment, the at least one protrusion extends around the pilfer band. Alternatively, in another embodiment, the at least one protrusion comprises a plurality of individual protrusions separated from one another by non-deformed portions of the pilfer band. Optionally, the at least one protrusion has a depth which is approximately equal to one half of the difference between an exterior diameter of the pilfer band and an interior diameter of the bottle annular ring. In one embodiment, the stud depth is between about 0.02 inches and about 0.1 inches. In another embodiment, the studs have a height of between about 0.06 inches and about 0.2 inches. Optionally, the pilfer band is severably interconnected to the ROPP closure by one or more of a serrated band and a score.

In one embodiment, the at least one protrusion is separated from a lowermost edge of the ROPP closure by a non-deformed portion of the pilfer band. In another embodiment, an upper neck portion above the annular ring is substantially concentric to a lower neck portion below the annular ring. Optionally, the upper neck portion has an exterior diameter that is approximately equal to an exterior diameter of the lower neck portion.

One aspect of the present invention is a studded rail configured to form a plurality of studs in a pilfer band of a ROPP closure sealed to a threaded bottle. The studded rail generally includes, but is not limited to: (1) a body with a first side; and (2) a plurality of punches extending from the first side, each of the plurality of punches configured to form a stud in the pilfer band, each of the studs extending at least partially into an annular ring of the threaded bottle. The studded rail is configured to receive the threaded bottle sealed by the ROPP closure. In one embodiment, the studded rail is configured remain substantially stationary as the threaded bottle rotates around its longitudinal axis into contact with the punches.

In one embodiment, the first side of the body has a concave shape. The concave first side of the body can optionally have a uniform radius of curvature. In another embodiment, each of the plurality of punches extends substantially radially from the first side.

In one embodiment, the punches have a diameter of up to approximately 0.1 inch. In another embodiment, the punch diameter is between about 0.04 inches and about 0.08 inches. The punches have a predetermined length extending from the first side of the studded rail. In one embodiment, the punch length is less than about 0.2 inches. In another embodiment, the length is greater than about 0.04 inches. In another embodiment, the punch length is between about 0.04 inches and about 0.2 inches.

The studded rail is configured to receive the threaded bottle sealed by the ROPP closure. In one embodiment, the studded rail is configured to rotate the threaded bottle around the longitudinal axis of the threaded bottle such that the ROPP closure rotates into at least one punch of the plurality of punches.

Another aspect of the present invention is a stud forming tool configured to form a plurality of studs in a pilfer band of a ROPP closure sealed to a threaded bottle. The stud forming tool generally includes, but is not limited to: (1) a plurality of segments; (2) a punch extending from each of the plurality of segments, the punch configured to form a stud in the pilfer band, the stud extending at least partially into an annular ring of the threaded bottle. Each of the plurality of segments are movable between a disengaged position and an engaged position. In the engaged positioned, the plurality of segments are configured to press their associated punches into the pilfer band. In this manner, the punches are configured to form a plurality of studs extending around a circumference of the pilfer band.

In one embodiment, the stud forming tool further includes a collet configured to move the plurality of segments from the disengaged position to the engaged position. Optionally, the each of the plurality of segments is pivotally interconnected to the stud forming tool. In one embodiment, the collect moves each of the plurality of segments substantially simultaneously.

Alternatively, in another embodiment, the stud forming tool includes a cam configured to move each of the plurality of segments from the disengaged position to the engaged position. In one embodiment, when the cam contacts a portion of a segment, the segment moves an associated punch into the engaged position. Optionally, each of the plurality of segments can move radially in response to a force received from the cam. In one embodiment, the cam moves each of the plurality of segments individually.

Each punch includes a free end. In one embodiment, when in the disengaged position, the free ends of the punches define a first circle with a first diameter. The first diameter is greater than an exterior diameter of the pilfer band of the ROPP closure. In another embodiment, when in the engaged position, the free ends of the punches define a second circle with a second diameter that is less than the first diameter. The second diameter is less than the exterior diameter of the pilfer band. Additionally, the second diameter is greater than an exterior diameter of the annular ring of the threaded bottle such that the free ends of the punches do not press against the bottle neck or the annular ring.

In one embodiment, the punches have a diameter of up to approximately 0.1 inch. In another embodiment, the punch diameter is between about 0.04 inches and about 0.08 inches. Each punch has a predetermined length extending from one of the plurality of segments. In one embodiment, the punch length is less than about 0.2 inches. In another embodiment, the length is greater than about 0.04 inches. In another embodiment, the stud length is between about 0.04 inches and about 0.2 inches.

The stud forming tool is configured to receive the threaded bottle after the threaded bottle is filled with a product and sealed with the ROPP closure. The plurality of segments are actuated to move from the disengaged position to the engaged position to form studs in the pilfer band of the ROPP closure. The plurality of segments then return to the disengaged position to release the threaded bottle. In one embodiment, the stud forming tool does not require a rotary motion. In one embodiment, the stud forming tool is interconnected to a prior art capping apparatus that has a vertical capping motion. Optionally, the stud forming tool is interconnected to a crown capping apparatus.

One aspect of the present invention is a stud forming tool with punches activated by a cam to form a plurality of studs in a pilfer band of a ROPP closure sealed to a threaded bottle. The stud forming tool generally includes one or more of, but is not limited to: (1) at least one carrier; (2) at least one punch extending from the at least one carrier; and (3) a cam configured to move the at least one punch to apply a force to the pilfer band to form studs extending at least partially into an annular ring of the threaded bottle. Optionally, the at least one punch is oriented approximately perpendicular to an exterior surface of the pilfer band. In one embodiment, the at least one punch is configured to move from a disengaged position to an engaged position in response to a force received from the cam. In another embodiment, the at least one punch moves approximately parallel to a radius of the ROPP closure when moving from the disengaged position to the engaged position. In the engaged positioned, the at least one punch is operable to press into, and apply a force to, the pilfer band. In this manner, the at least one punch is configured to form a plurality of studs extending around a circumference of the pilfer band. In one embodiment, the at least one punch is biased in the disengaged position.

In one embodiment, the at least one carrier remains substantially stationary as the at least one punch moves from the disengaged position to the engaged position. For example, in one embodiment, the at least one punch extends through the at least one carrier. Specifically, in one embodiment, the at least one punch is movably associated with the at least one carrier that is stationary.

Alternatively, in another embodiment, the at least one punch is rigidly associated with the at least one carrier. Accordingly, in one embodiment, both the at least one carrier and the at least one punch move from a disengaged positioned to an engaged position in response to a force received from the cam. The at least on carrier moves in response to contact with the cam such that the at least one punch moves to the engaged position.

In one embodiment, the at least one carrier comprises a plurality of carriers. Each of the plurality of carriers includes an interior surface and an exterior surface. A punch is associated with a carrier of the plurality of carriers. The punch extends from the interior surface of the carrier. The plurality of carriers are arranged proximate each other. The interior surfaces of the plurality of carriers define a chamber. The chamber has an interior diameter greater than an exterior diameter of the ROPP closure. In one embodiment, the punch is rigidly interconnected to the carrier. Optionally, the punch and carrier are biased outwardly in the disengaged position. Alternatively, in another embodiment, the punch is moveably interconnected to the carrier. Optionally, the punch is biased outwardly in the disengaged position.

In another embodiment, the at least one carrier includes a body. The body has an interior surface and an exterior surface. The interior surface defines a chamber with an interior diameter greater than an exterior diameter of the ROPP closure. The at least one punch of the stud forming tool comprises a plurality of punches extending through the body. Each of the plurality of punches is moveably interconnected to the carrier. In one embodiment, each of the plurality of punches is biased outwardly in a disengaged position. The cam is configured to rotate around the exterior surface of the body. Each of the plurality of punches is configured to move inwardly to an engaged position in response to a force received from the cam.

In one embodiment, the cam is configured to rotate around the at least one carrier. The at least one carrier does not rotate with respect to the threaded bottle. In one embodiment, the cam rotates around an axis that is not concentric with a longitudinal axis of the threaded bottle. Optionally, the cam contacts a portion of the at least one carrier as the cam rotates around the at least one carrier. In response to contact of the cam with a first carrier, a first punch associated with the first carrier moves to the engaged position. As the cam rotates into contact with a second carrier, a second punch associated with the second carrier moves to the engaged position and the first punch returns to the disengaged position. Accordingly, in one embodiment, the cam is configured to sequentially move each of a plurality of punches associated with the stud forming tool into the engaged position. Optionally, in one embodiment, the stud forming tool may include two or more cams. In this manner, two or more punches may be in the engaged position at substantially the same time.

In one embodiment, the at least one punch comprises a plurality of punches. Each punch of the plurality of punches includes a free end. In one embodiment, when the plurality of punches are in the disengaged position, the free ends of the plurality of punches define a first circle with a first diameter. The first diameter is greater than an exterior diameter of the pilfer band of the ROPP closure.

In one embodiment, the at least one punches has a diameter of up to approximately 0.1 inch. In another embodiment, the punch diameter is between about 0.04 inches and about 0.08 inches. The at least one punch has a predetermined length extending from the at least one carrier. In one embodiment, the punch length is less than about 0.2 inches. In another embodiment, the length is greater than about 0.04 inches. In another embodiment, the stud length is between about 0.04 inches and about 0.2 inches.

The stud forming tool is configured to receive the threaded bottle after the threaded bottle is filled with a product and sealed with the ROPP closure. The cam moves around the threaded bottle such that each punch of the at least one punch moves from the disengaged position to the engaged position. In one embodiment, the cam sequentially activates each punch. In one embodiment, the stud forming tool is interconnected to a prior art capping apparatus that has a vertical motion and a rotary motion. Optionally, the stud forming tool is interconnected to a capping apparatus such as a screw cap torque capper.

Although generally referred to herein as a "bottle," "beverage bottle," "metallic beverage bottle," "metallic container," "beverage container," "aluminum bottle," "can," and "container," it should be appreciated that the methods and apparatus described herein may be used to seal containers of any size or shape and that are formed of any material, including, but not limited to metal, plastic, and glass containers including, without limitation, beverage cans and beverage bottles. Accordingly, the term "container" is intended to cover containers of any type and formed of any material that are subsequently sealed with a threaded closure, such as a Roll-On Pilfer Proof (ROPP) closure. Further, as will be appreciated by one of skill in the art, the methods and apparatus of the present invention may be used for any type of metallic container and are not specifically limited to a beverage container such as a soft drink or beer can.

As used herein, the phrase "light-weight metallic bottle" refers to a metallic bottle formed of a reduced amount of metal material than prior art metallic bottles. Accordingly, light-weight metallic bottles have a reduced material thickness in one or more predetermined portions of the metallic bottle compared to prior art metallic bottles. In some embodiments, the light-weight metallic bottle is both thinner (i.e., less gauge) and has less mass than prior art metallic bottles. In one embodiment, at least a portion of the metallic bottle has a thickness that is approximately 95% of the thickness of a corresponding portion of a prior art metallic bottle formed of the same material. It will be appreciated by one of skill in the art that a light-weight metallic bottle formed of even slightly less material compared to a prior art metallic bottle will save manufacturers, bottlers, and shippers millions of dollars annually based on the billions of bottles currently produced annually.

The terms "metal" or "metallic" as used hereinto refer to any metallic material that may be used to form a container, including without limitation aluminum, steel, tin, and any combination thereof. However, it will be appreciated that the apparatus and methods of the present invention may be used to seal threaded containers formed of any material, including paper, plastic, and glass.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary of the Invention, Brief Description of the Drawings, Detailed Description, Abstract, and Claims themselves.

The Summary of the Invention is neither intended, nor should it be construed, as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements or components. Additional aspects of the present invention will become more readily apparent from the Detailed Description, particularly when taken together with the drawings.

BRIEF DESCRIPTION OF THE DRAWINGS

The accompanying drawings, which are incorporated herein and constitute a part of the specification, illustrate embodiments of the invention and together with the Summary of the Invention given above and the Detailed Description given below serve to explain the principles of these embodiments. In certain instances, details that are not necessary for an understanding of the disclosure or that render other details difficult to perceive may have been omitted. It should be understood, of course, that the present invention is not necessarily limited to the particular embodiments illustrated herein. Additionally, it should be understood that the drawings are not necessarily to scale.

Figure 1B:
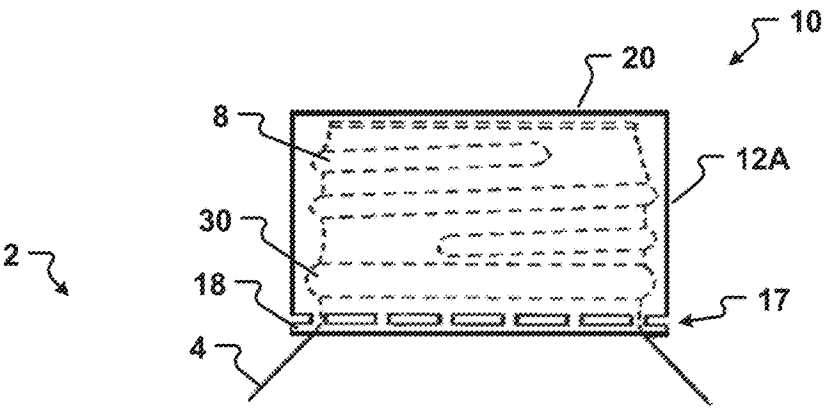
Fig. 1B (Prior Art)
FIGS. 1A-1D illustrate a method of sealing a metallic bottle with a ROPP closure using a prior art capping apparatus.
Figure 1A:
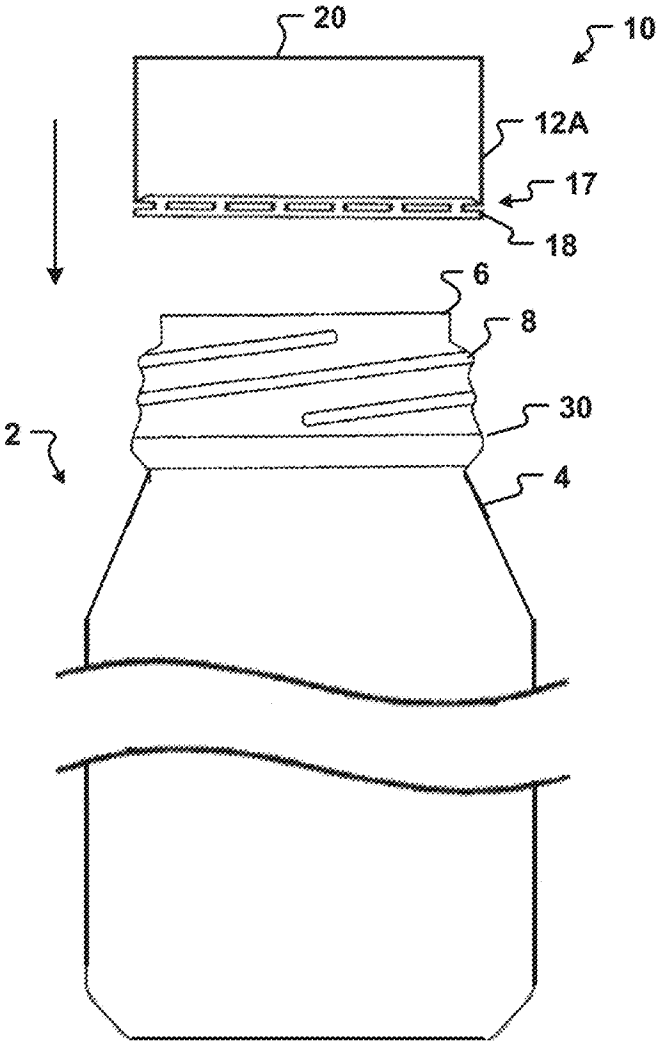
Fig. 1A (Prior Art)
Figure 1C:
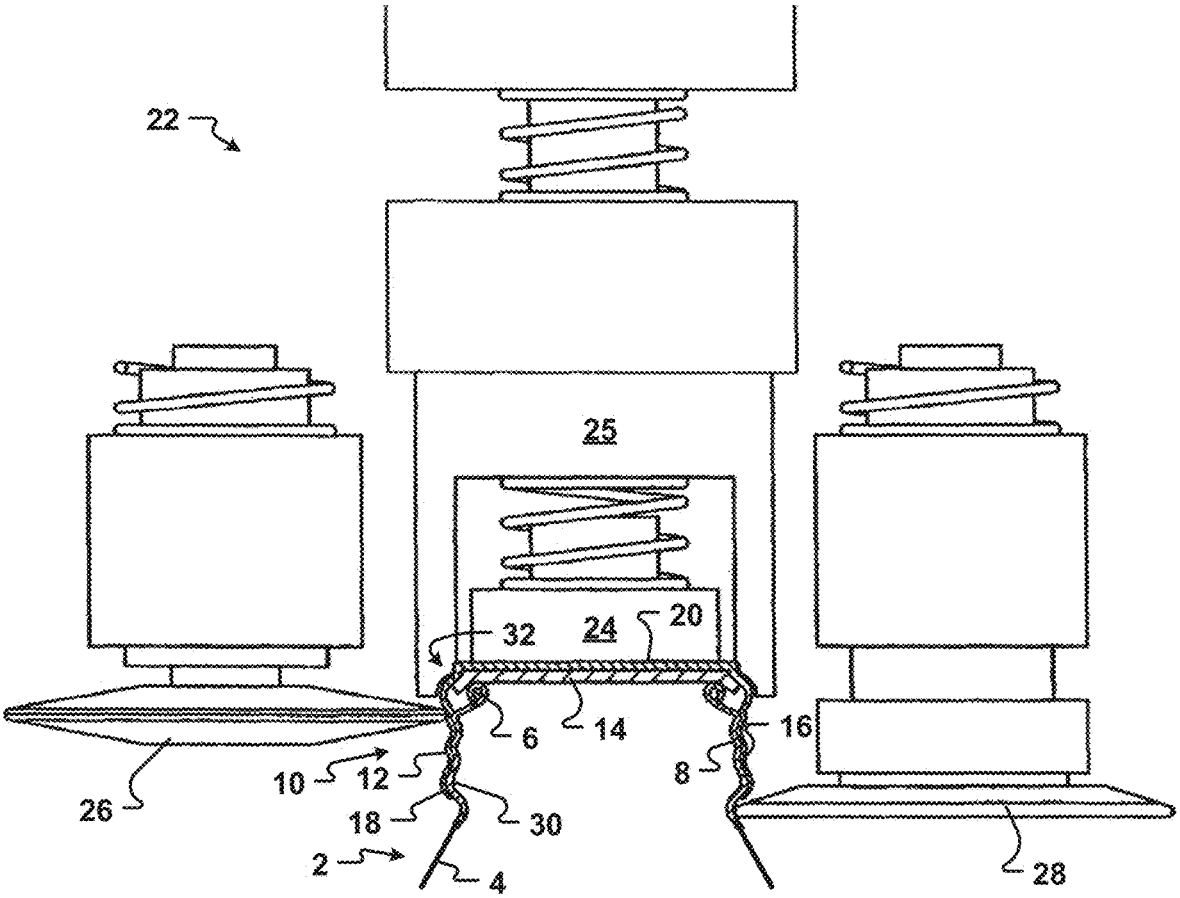
Fig. 1C (Prior Art)
Figure 1D:
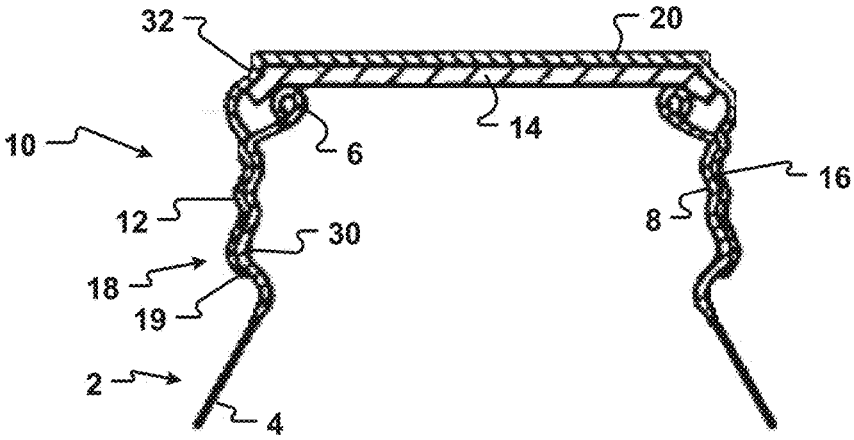
Fig. 1D (Prior Art)
Figure 1E:
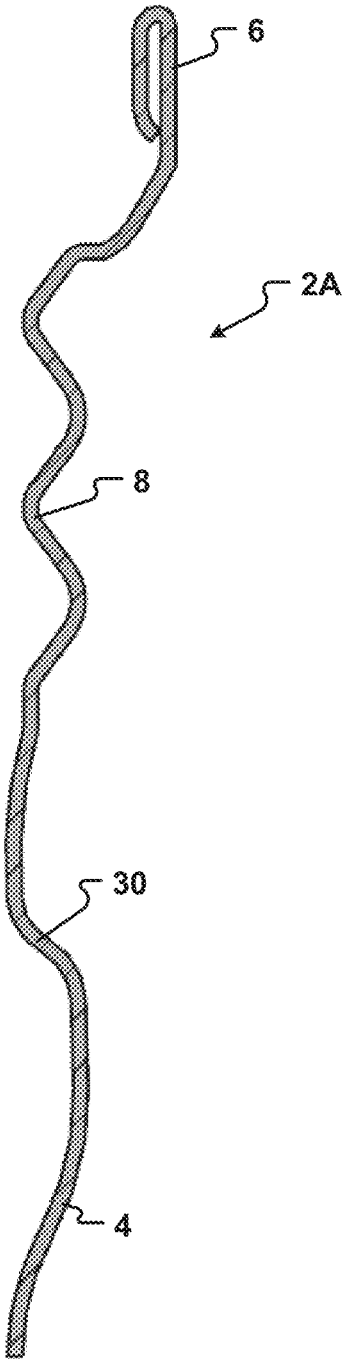
Fig. 1E (Prior Art)
FIG. 1E is a partial cross-sectional front elevation view of a portion of a neck of a prior art metallic bottle before the metallic bottle is sealed with a ROPP closure.
Figure 1F:
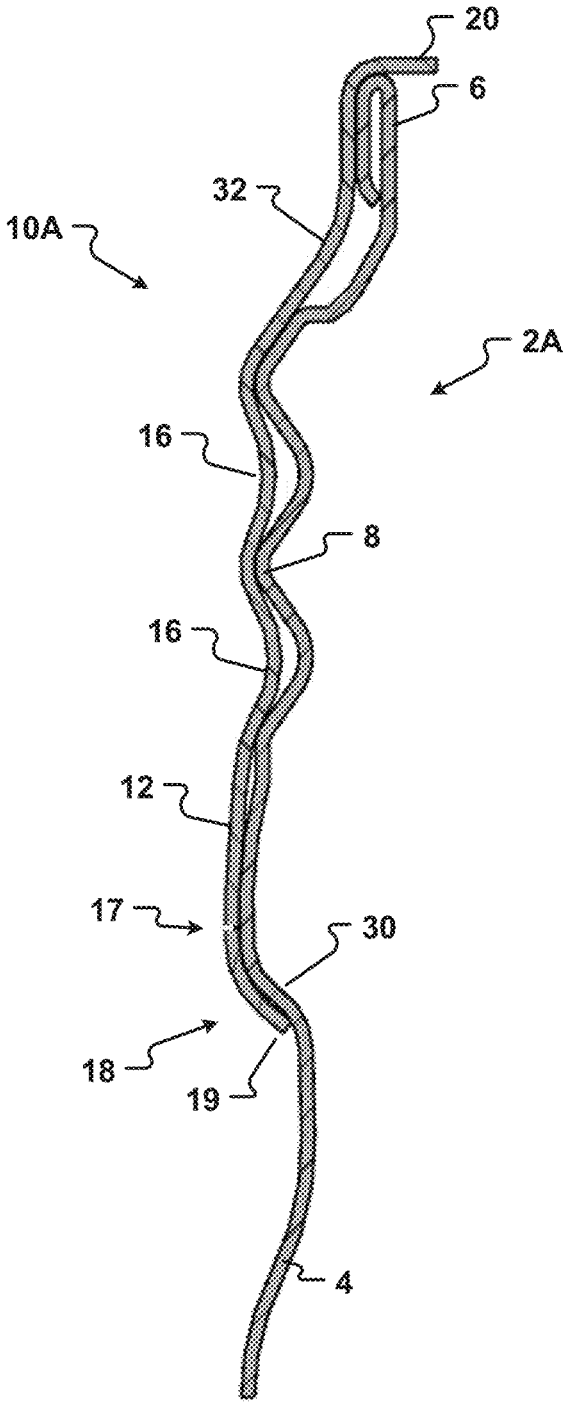
Fig. 1F (Prior Art)
FIG. 1F is another partial cross-sectional front elevation view of the neck portion of the prior art metallic bottle of FIG. 1E after the metallic bottle has been sealed with a prior art ROPP closure.

To assist in the understanding of one embodiment of the present invention the following list of components and associated numbering found in the drawings is provided herein:

| Number | Component |
|---|---|
| 2 | Bottle |
| 4 | Neck portion |
| 6 | Curl |
| 8 | Bottle threads |
| 10 | ROPP closure |
| 12 | Body portion of ROPP closure |
| 14 | ROPP liner |
| 16 | Closure threads |
| 17 | Serrated band or area of weakness |
| 18 | Pilfer band |
| 19 | Bottom edge of pilfer band |
| 20 | Top portion of ROPP closure |
| 22 | Prior art capping apparatus |
| 24 | Pressure block ejector |
| 25 | Pressure block |
| 26 | Thread roller |
| 28 | Pilfer roller |
| 30 | Skirt of metallic bottle |
| 32 | Channel of closure |
| 36 | Bottle |
| 37 | Longitudinal axis of the bottle |
| 38 | Neck portion |
| 38A | Neck portion above annular ring |
| 38B | Neck portion below annular ring |
| 39 | Neck portion |
| 40 | Threads of bottle |
| 41 | Body or sidewall |
| 42 | Closed-end |
| 43 | Curl |
| 44 | Annular ring of bottle |
| 45 | Depth of annular ring |
| 46 | Upper portion of annular ring |
| 47 | Lower portion of annular ring |
| 48 | Rollers |
| 49 | Height of annular ring |
| 50 | ROPP shell |

-continued

| Number | Component |
|---|---|
| 51 | Closed end-wall |
| 52 | Body portion of ROPP shell |
| 54 | Area of weakness (serrated band or score) |
| 56 | Pilfer band |
| 58 | Length of ROPP shell |
| 59 | Length of Pilfer band |
| 60 | Capping apparatus |
| 62 | Pressure block ejector |
| 64 | Pressure block |
| 66 | Thread roller |
| 68 | Pilfer roller |
| 70 | ROPP closure |
| 72 | Closed end-wall |
| 74 | Closure channel |
| 76 | Closure body |
| 78 | Closure threads |
| 80 | Pilfer band |
| 81 | Upper portion of pilfer band |
| 82 | Protrusion of pilfer band |
| 83 | Lower portion of pilfer band |
| 84 | Lowermost edge of pilfer band |
| 85 | Interior surface of pilfer band |
| 86 | Stud or indentation |
| 88 | Non-deformed portion of pilfer band |
| 89 | Uppermost edge of pilfer band |
| 90 | Depth of protrusion or stud |
| 92 | Width or height of protrusion or stud |
| 94 | Pilfer band height |
| 100 | Stud roller |
| 102 | Shaft |
| 104 | Head |
| 105 | Pocket |
| 106 | Punches |
| 107 | Distal end of punch |
| 108 | Punch diameter |
| 109 | Punch length |
| 110 | Studded rail |
| 111 | Pocket height |
| 112 | Body |
| 114 | First side |
| 120 | Tool for forming studs |
| 122 | Segments |
| 124 | Disengaged position |
| 126 | Engaged position |
| 128 | Collet |
| 130 | Cam actuated stud forming tool |
| 131 | Body |
| 132 | Carrier |
| 133 | Aperture |
| 134 | Interior surface |
| 135 | Exterior surface |
| 136 | Opening or chamber |
| 138 | Cam |
| 140 | Cam axis |
| R1 | First radius |
| R2 | Second radius |
| R3 | Third radius |

DETAILED DESCRIPTION

The present invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention. Additionally, it is contemplated that various features and devices shown and/or described with respect to one embodiment or figure may be combined with or substituted for features or devices of other embodiments or figures regardless of whether or not such a combination or substitution is specifically shown or described herein.

Figure 2:
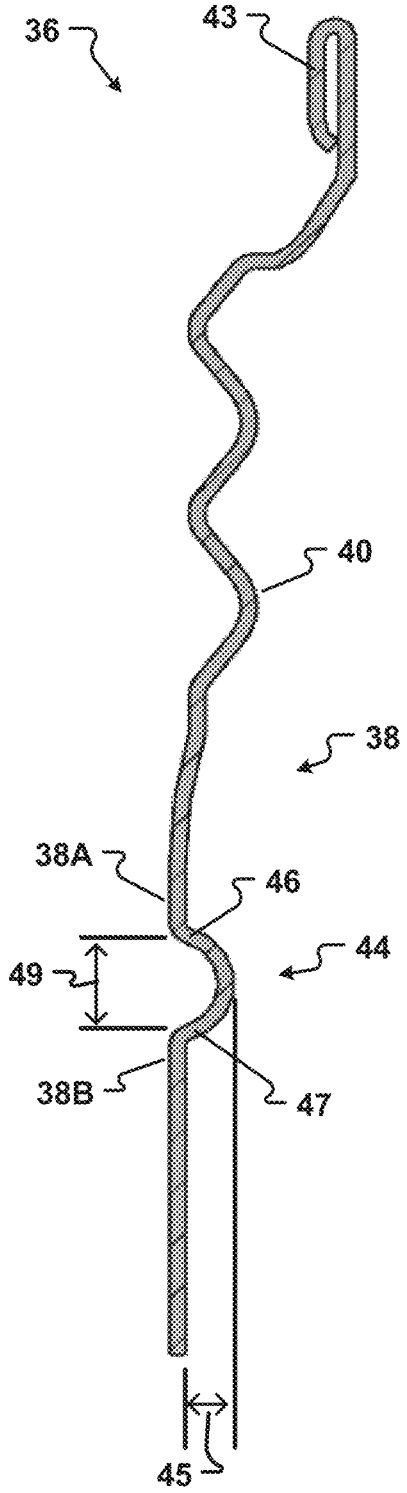
FIG. 2 is a partial cross-sectional front elevation view of a portion of a neck of a metallic bottle of one embodiment of the present invention before the metallic bottle is sealed with a ROPP closure and depicting the annular ring.

Referring now to FIG. 2, a threaded neck portion 38 of a bottle 36 of one embodiment of the present invention is illustrated. The bottle 36 can optionally be formed of one of a metal, a plastic, and a glass. In one embodiment, the bottle 36 is formed of metal. The bottle 36 generally includes a neck portion 38 with threads 40 and a curl 43 formed at an uppermost portion of the neck portion proximate to an opening.

A groove or annular ring 44 is formed on a portion of the neck 38. An upper portion 46 of the annular ring 44 is positioned proximate to the threads 40. The annular ring 44 has a predetermined geometry and a predetermined depth 45. Optionally, the annular ring 44 can have a cross-sectional profile that forms a portion of a circle or of an ellipse; however, as will be appreciated by one skilled in the art, other geometries can be used. For example, in one embodiment, the annular ring 44 has substantially linear sidewalls and a substantially linear end-wall. In this embodiment, the annular ring 44 has a cross section of three sides of a quadrilateral. The three sides of the quadrilateral may optionally be generally perpendicular. In another embodiment, the annular ring 44 has two substantially linear sidewalls that intersect at an angle. Accordingly, in this embodiment, the annular ring 44 has a generally V-shaped cross section.

The annular ring 44 may have any predetermined depth 45. In one embodiment, the depth 45 is at least about 0.03 inches. In another embodiment, the depth is at least about 0.04 inches. In still another embodiment, the depth is at least about 0.045 inches. In yet another embodiment, the depth 45 is at least about 0.05 inches. In another embodiment, the depth is between about 0.3 inches and about 0.1 inch. In one embodiment, the depth of the annular ring 44 is between about 0.025 inches and about 0.08 inches. Optionally, the depth 45 of the annular ring may be related to a diameter of the neck portion 38 of the metallic bottle 36. Accordingly, for a bottle 36 with a smaller diameter the depth 45 is at least about 0.04 inches and for a second bottle with a larger diameter, the depth is at least about 0.05 inches. In one embodiment, the depth 45 is less than a depth of a skirt of known bottles 2.

The annular ring 44 has a predetermined height 49. Optionally, the height 49 is at least about 0.03 inches. In one embodiment, the height is at least about 0.06 inches. In one embodiment, the height 49 is less than about 0.20 inch. In another embodiment, the height is less than about 0.25 inches. In one embodiment, the height 49 is between about 0.03 inches and about 0.2 inches. In another embodiment, the height 49 of the annular ring is between about 0.1 inch and about 0.18 inch.

In one embodiment, a portion of the neck 38A above the annular ring 44 has a diameter that is about equal to a diameter of a portion of the neck 38B below the annular ring 44. The neck portion 38A may also be approximately concentric with the neck portion 38B.

Accordingly, in one embodiment of the present invention, the annular ring 44 is formed in a portion of the neck 38 with a substantially uniform diameter. More specifically, in one embodiment, the annular ring 44 may be formed in a portion of the neck 38 that is generally parallel to a longitudinal axis of the bottle 36. In another embodiment, a longitudinal cross-section of the neck portion 38A and a longitudinal cross-section of the neck portion 38B are co-planar.

Optionally, the bottle 36 is formed of one of a metal, a plastic, and a glass. When the bottle 36 is formed of metal, the annular ring 44 may be formed by spin shaping the neck portion 38. More specifically, the annular ring 44 can be formed without expanding the neck portion 38 outwardly or die necking the neck portion inwardly. In one embodiment, the annular ring 44 may be formed in a single operation by a metal forming tool. In one embodiment, the metal forming tool is a roller.

In one embodiment, the annular ring 44 is formed by a thread forming apparatus which forms the bottle threads 40. Optionally, the thread forming apparatus may include an exterior tool that applies a force to an exterior surface of the neck portion 38. The exterior tool may be substantially aligned with a desired centerline of the annular ring 44. The exterior tool may rotate around a longitudinal axis of the bottle 36 one or more time to form the annular ring 44. The thread forming apparatus may additionally include an interior tool that supports at least one interior surface portion of the neck 38. For example, in one embodiment, the interior tool may contact the interior surface portion of the neck 38 proximate to at least one of the upper portion 38A or the lower portion 38B. In one embodiment, the neck portion 38 is pinched between surfaces of the exterior tool and the interior tool proximate to the upper and lower portions 38A, 38B.

Figure 2A:
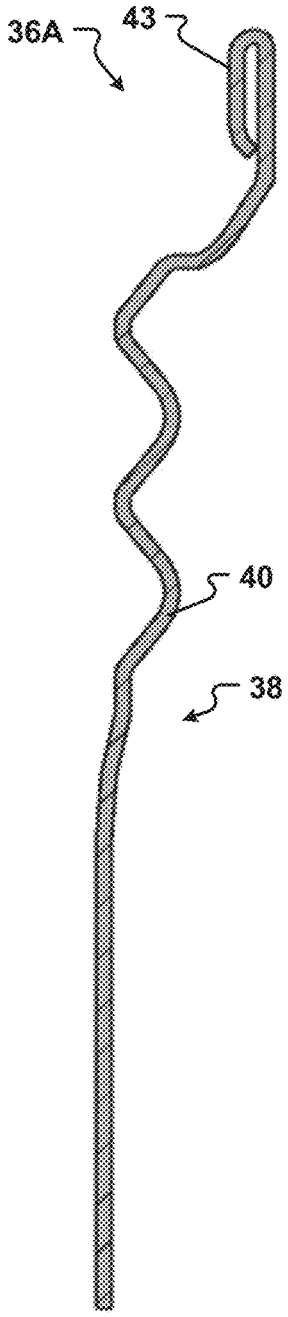
FIGS. 2A-2C are partial cross-sectional front elevation views of a portion of a neck of another metallic bottle and illustrating tooling and a method of forming an annular ring in the neck portion of the metallic bottle.
Figure 2B:
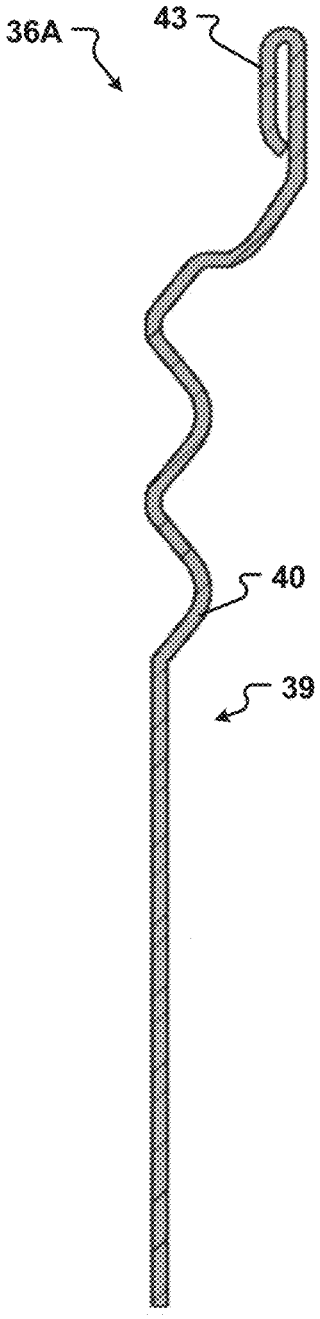
Figure 2C:
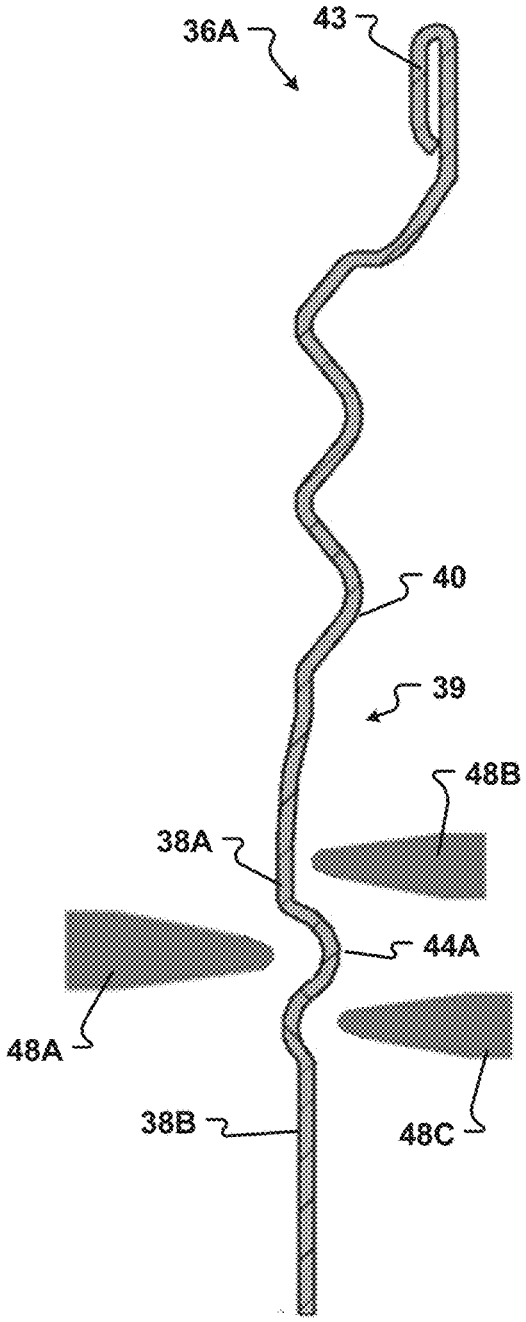

Referring now to FIGS. 2A-2C, an annular ring 44A of the present invention may also be formed by necking the neck portion 38 and then pressing spinning tools, such as rollers, against predetermined portions of the neck 38. More specifically, and referring to FIG. 2A, after the bottle threads 40 are formed, the neck portion 38 has a first diameter. The neck portion 39 below the bottle threads 40 may be necked to a reduced diameter as generally illustrated in FIG. 2B. In one embodiment, the reduced diameter of the neck 39 is about half-way between the first diameter and an interior diameter of the annular ring 44A to be formed.

Referring now to FIG. 2C, rollers 48 press against predetermined portions of the neck portion 39 to form the annular ring 44A. In one embodiment, an exterior roller 48A applies a force to an exterior surface of the neck portion 39 substantially centered on a centerline of the annular ring 44A being formed. Additionally, or alternatively, one or more interior rollers 48B, 48C apply a force to interior surfaces of the neck portion 39 above and below the centerline of the annular ring 44A. As generally illustrated in FIG. 2C, an upper portion 38A of the neck portion 39 has a first diameter, the annular ring 44A has a second diameter, and a lower portion 38B of the neck portion 39 below the annular ring 44A has a third diameter. In one embodiment, the third diameter is approximately mid-way between the first diameter and the second diameter. More specifically, in one embodiment, the third diameter is approximately equal to the average of the first and second diameters. Accordingly, the diameter of the upper portion 38A is about equal to the diameter of the upper portion 38A illustrated in FIG. 2. The diameter of the lower portion 38B of neck 39 is less than the diameter of the lower portion 38B illustrated in FIG. 2.

The rollers 48 may be the same as, or similar to, thread rollers known to those of skill in the art. Accordingly, the rollers 48 may be operable to rotate in one or more directions around an axis generally parallel to a longitudinal axis of the metallic bottle 36A. Additionally, or alternatively, one or more of the rollers 48 may be operable to rotate around the circumference of the metallic bottle 36A while applying a predetermined force to the neck portion 38A. Examples of thread rollers and methods of forming threads on containers are described in U.S. Patent App. Pub. No. 2015/0225107 which is incorporated herein by reference in its entirety.

Figure 3:
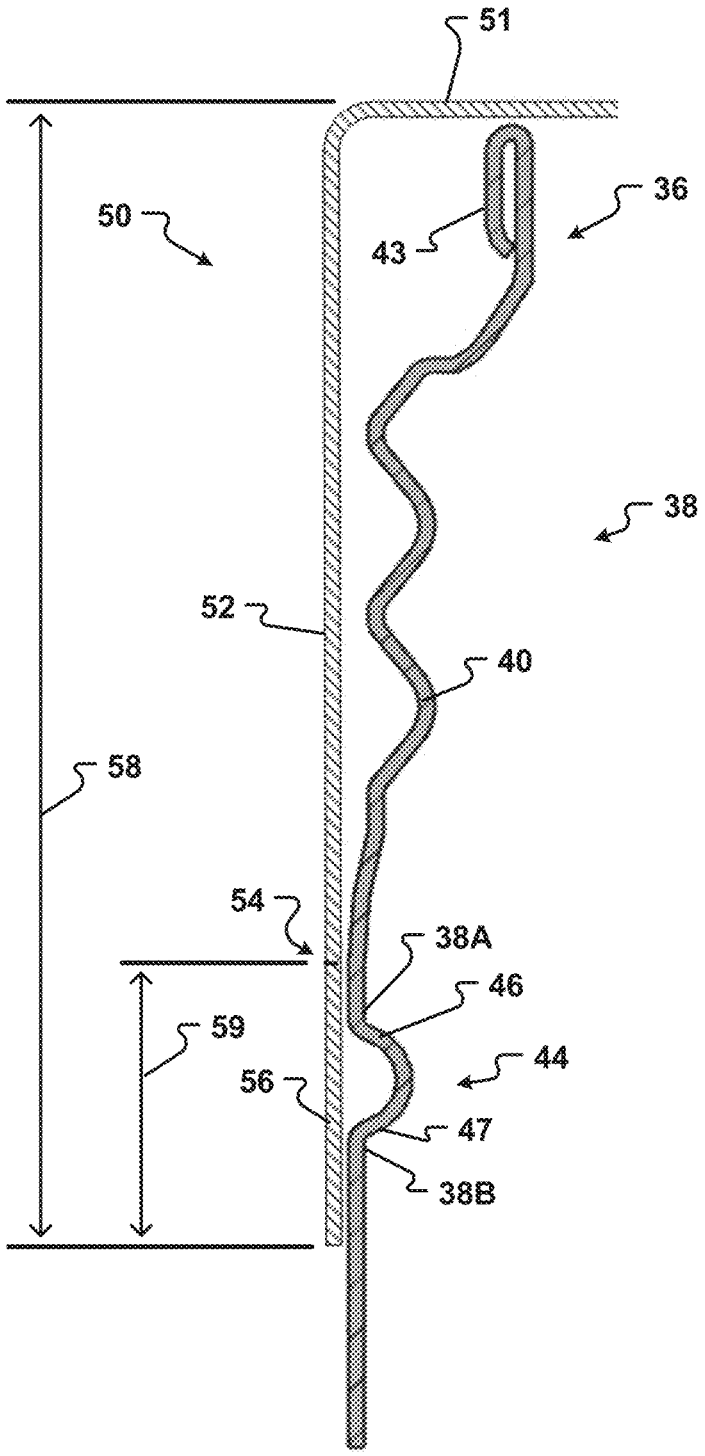
FIG. 3 is another partial cross-sectional front elevation view of the neck of the metallic bottle of FIG. 2 with a ROPP shell of an embodiment of the present invention positioned on a neck portion of the metallic bottle.

Referring now to FIG. 3, a ROPP shell 50 is placed on the neck portion 38 to seal the bottle 36 after the bottle is filled with a product, such as a beverage. The ROPP shell 50 generally includes a closed end-wall 51, a cylindrical body portion 52 extending downwardly from the closed end-wall, and a pilfer band 56 releasably interconnected to the body portion 52 by an area of weakness 54. In one embodiment, the area of weakness 54 is a serrated band. Optionally, the area of weakness 54 may include a score.

When positioned on the bottle 36, the ROPP shell 50 covers the bottle threads 40 and the pilfer band 56 extends downward past the annular ring 44 of the bottle 36. In one embodiment, the ROPP shell 50 has a length 58 that is greater than the length of the prior art ROPP shell 10. Additionally, or alternatively, the pilfer band 56 has a greater length 59 than the pilfer band 18 of the ROPP shell 10. More specifically, in one embodiment, the pilfer band length 59 is at least about 0.15 inches longer than a prior art pilfer band 18. In another embodiment, the pilfer band 59 of the present invention has a length 59 that is between about 0.15 inches and about 0.2 inches longer than pilfer band 18. In another embodiment, the ROPP shell length 58 is between about 0.15 inches and about 0.2 inches longer than the length of the prior art ROPP shell 10. At least a portion of the pilfer band 56 extends beyond a lowermost portion of the annular ring 44 proximate to the lower neck portion 38B. Thus, in one embodiment of the present invention, the ROPP shell 50 comprises more material than the prior art ROPP shell 10. However, the increased material cost of the ROPP shell 50 overcomes one or more of the deficiencies of the prior art ROPP shell 10 described above.

Figure 4:
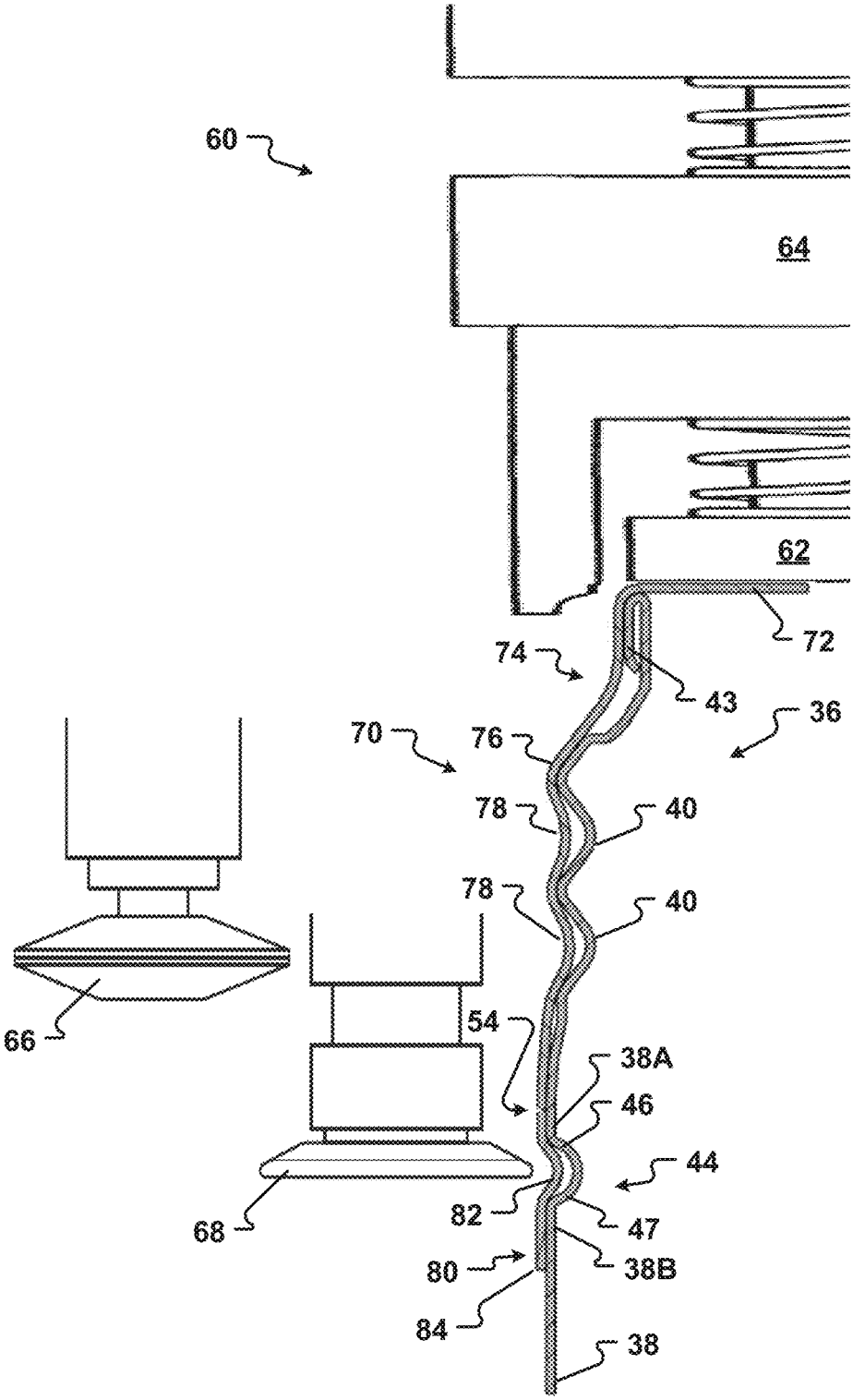
FIG. 4 is a partial cross-sectional front elevation view of a capping apparatus of one embodiment of the present invention sealing the metallic bottle and converting the ROPP shell of FIG. 3 into a ROPP closure of one embodiment of the present invention.

Referring now to FIG. 4, a capping apparatus 60 subsequently forms the ROPP shell 50 into a ROPP closure 70. The capping apparatus 60 is similar to a prior art capping apparatus 22 and generally includes a pressure block ejector 62, a pressure block 64, a thread roller 66, and a pilfer roller 68.

The pressure block ejector 62 and the pressure block 64 apply a top load to a closed end-wall 72 of the ROPP closure 70. The top load seals the ROPP closure 70 to an exterior of the bottle curl 43. The pressure block 64 may also reform a peripheral edge of the ROPP closure 70 to form a reform or channel 74 with a decreased diameter in the ROPP closure 70.

After the capping apparatus 60 has sealed the bottle opening with the ROPP closure 70, the thread roller 66 forms threads 78 on a portion of the closure body 76. The thread roller 66 generally applies a force to an exterior surface portion of the ROPP closure 70 and uses the bottle threads 40 as a mandrel, winding downwardly around a circumference of the ROPP closure 70.

The pilfer roller 68 applies a force to a portion of the pilfer band 80 to press a portion of the pilfer band 80 at least partially into the bottle annular ring 44. The pilfer roller 68 forms a protrusion 82 that extends inwardly from an interior surface of the pilfer band 80. The protrusion 82 is keyed to the annular ring 44. In one embodiment, the protrusion 82 has a depth that is less than the depth of the annular ring 44. The pilfer roller 68 may form the protrusion 82 before, after, or during formation of the closure threads 78 by the thread roller 66.

The pilfer roller 68 is similar to the pilfer roller 28 of the prior art capping apparatus 22; however, the pilfer roller 68 does not contact the bottle 36 when forming the inwardly oriented protrusion 82. In one embodiment, the pilfer roller 68 contacts a portion of the pilfer band 80 between an upper edge 46 and a lower edge 47 of the annular ring 44. Thus, in contrast to pilfer roller 28, the pilfer roller 68 of the present invention contacts a portion of the ROPP closure 70 spaced from a lowermost edge 84 of the pilfer band 80. In another embodiment, the pilfer roller 68 contacts a portion of the pilfer band 80 substantially aligned with a center portion of the annular ring 44. In this manner, the pilfer roller 68 does not apply a force directly to the bottle 36.

Figure 5:
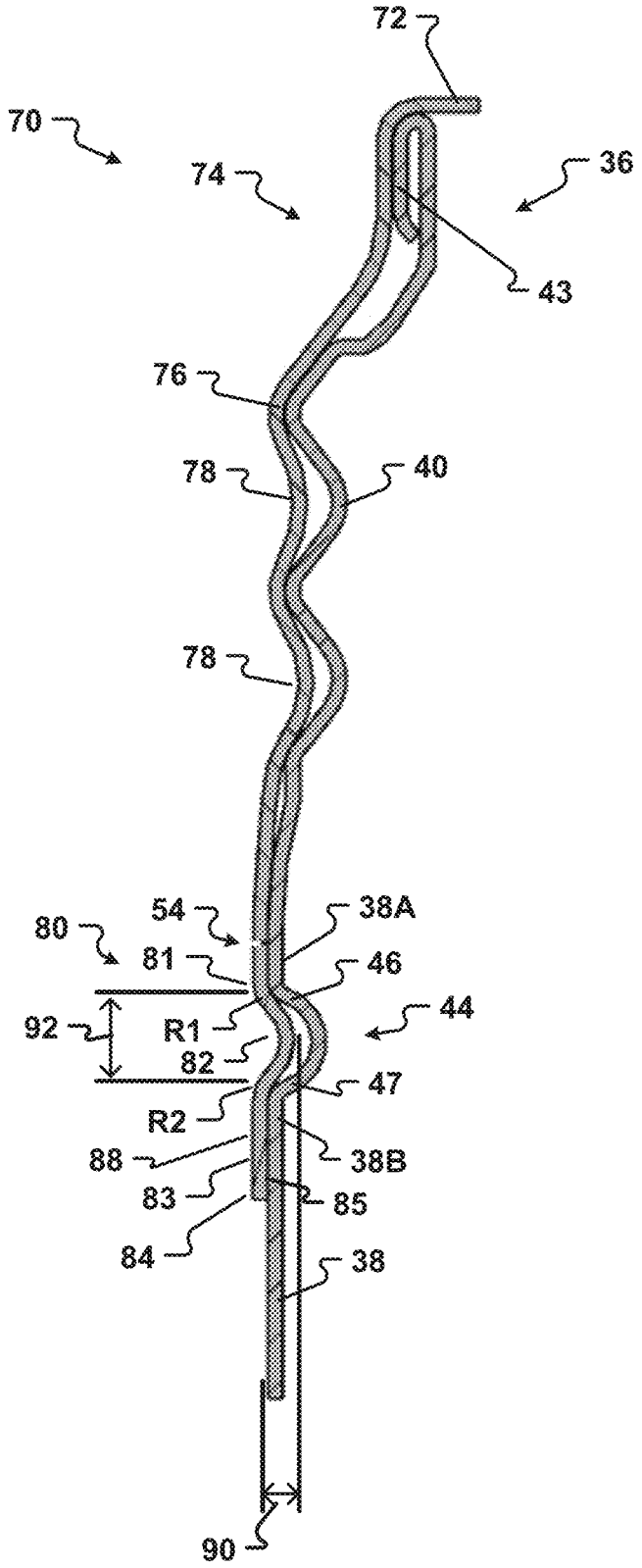
FIG. 5 is another partial cross-sectional front elevation view of the neck of the metallic bottle of FIG. 2 sealed with a ROPP closure of one embodiment of the present invention.

Referring now to FIG. 5, a portion of a bottle 36 sealed by a ROPP closure 70 of one embodiment of the present invention is illustrated. The protrusion 82 of the pilfer band 80 projects at least partially into the bottle annular ring 44 such that the pilfer band 80 may not be removed from the bottle 36. More specifically, the interior diameter of the protrusion 82 is less than the diameter of the upper portion 46 of the annular ring 44 and the upper neck portion 38A.

In one embodiment, when sealed to a bottle 36, the pilfer band 80 includes an upper portion 81 proximate to the serrated band 54, a medial portion including the inwardly oriented protrusion 82, and a lower portion 83 that is located proximate to a lowermost edge 84 of the ROPP closure 70. Optionally, the upper and lower portions 81, 83 are generally cylindrical and have a substantially collinear cross-section. In one embodiment, the upper 81 and lower 83 portions are cylinders that are substantially concentrically aligned and having substantially equal diameters. In another embodiment, the upper and lower portions 81, 83 are generally parallel. In one embodiment, the upper portion 81 is interconnected to the medial portion by a first radius R1 and the lower portion 83 is interconnected to the medial portion by a second radius R2. In another embodiment, the first and second radii R1, R2 are substantially equal. In yet another embodiment, a longitudinal cross-section of the upper portion 81 and of the lower portion 83 are co-planar.

The protrusion 82 extends inwardly from an interior surface 85 of the pilfer band 80. The protrusion 82 has a predetermined depth 90 measured from the interior surface 85 of the pilfer band. In one embodiment, the protrusion 82 has a depth 90 of between about 0.02 inches and about 0.03 inches. In another embodiment, the depth 90 is up to about 0.04 inches. In one embodiment, the protrusion depth 90 is between about 0.025 inches and about 0.1 inch. In another embodiment, the protrusion depth 90 is approximately halfway between an exterior diameter of the pilfer band 80 and an interior diameter of the bottle annular ring 44.

The protrusion 82 may have a predetermined height 92. In one embodiment, the height is less than about 0.2 inches. In another embodiment, the height is less than about 0.1 inch. In another embodiment, the height 92 is at least about 0.03 inches. In one embodiment, the height is greater than about 0.06 inches. Optionally, the height 92 is between about 0.06 inches and about 0.2 inches. In another embodiment, the protrusion height 92 is between about 0.1 inch and about 0.2 inches. In one embodiment, the protrusion 82 is spaced from the lowermost edge 84 of pilfer band by a non-deformed portion 88 of the pilfer band.

Figure 6:
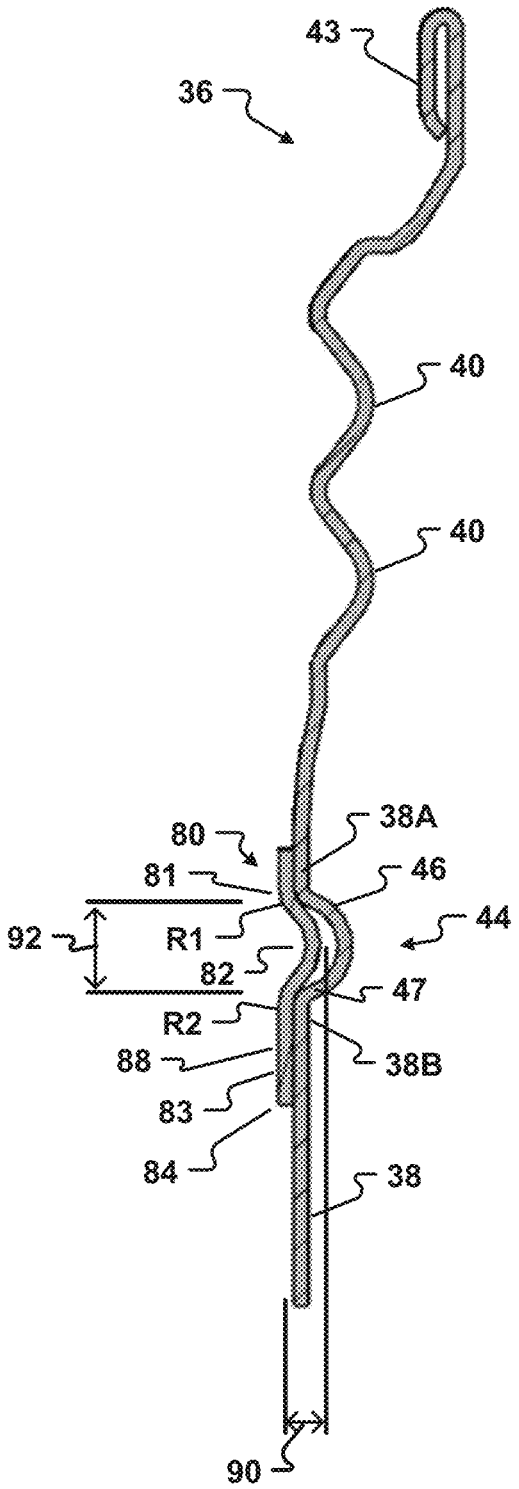
FIG. 6 is a partial cross-sectional front elevation view of the neck of the metallic bottle of FIG. 5 after the ROPP closure has been removed from the metallic bottle and illustrating the pilfer band retained on the bottle neck.

When rotated in an opening direction (typically counter-clockwise), the ROPP closure 70 moves axially away from the closed bottom portion of the bottle 36. As the ROPP closure 70 continues rotating in the opening direction, the closure protrusion 82 contacts the ring upper portion 46. The upper portion 46 applies a force to the pilfer band 80. The force is sufficient to fracture the serrated band 54 of the ROPP closure 70. The pilfer band 80 then separates from the rest of the ROPP closure 70 such that the pilfer band 80 is retained on the neck portion 38 of the bottle 36. The ROPP closure 70 can then be removed from the bottle 36, as illustrated in FIG. 6.

In one embodiment, the upper portion 81 of the pilfer band 80 has an interior diameter substantially equal to the exterior diameter of the upper neck portion 38A. Similarly, the lower portion 83 of the pilfer band 80 has an interior diameter substantially equal to an exterior diameter of the lower neck portion 38B. Accordingly, in one embodiment, there is generally no gap or space between upper band portion 81 and upper neck portion 38A and between lower band portion 83 and lower neck portion 38B. For example, as illustrated in FIG. 6, in one embodiment of the present invention, there is no gap between the upper or lower portions 81, 83 of the pilfer band and the bottle neck 38 when the ROPP closure is removed from the bottle. Thus, the upper and lower portions 81, 83 do not flare outwardly away from the bottle 36, decreasing, or eliminating, a cutting hazard.

Figure 7:
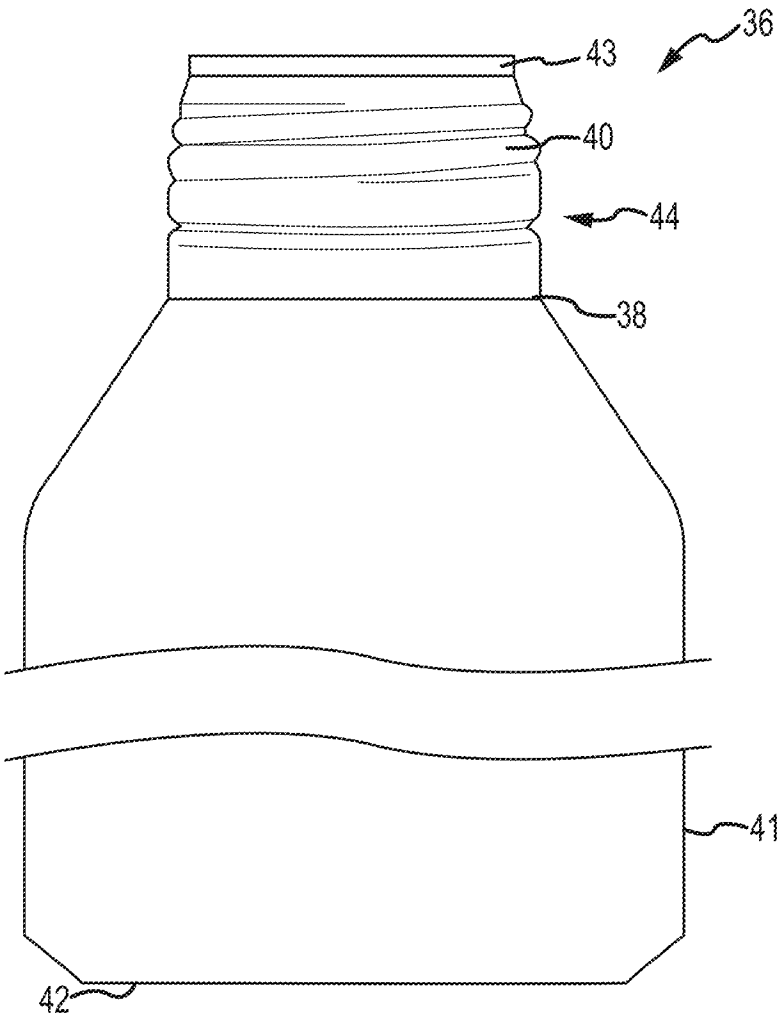
FIG. 7 is a front elevation view of a metallic bottle including an annular ring according to one embodiment of the present invention.

Referring now to FIG. 7, a front elevation view of a metallic bottle 36 according to one embodiment of the present invention is shown. The metallic bottle generally includes a closed-end 42, a body 41 that is generally cylindrical, a neck portion 38 with a decreased diameter extending from the body portion 41, threads 40 formed on a portion of the neck 38, and an annular ring 44 formed on the neck 38 between the body 41 and the threads 40.

Figure 8:
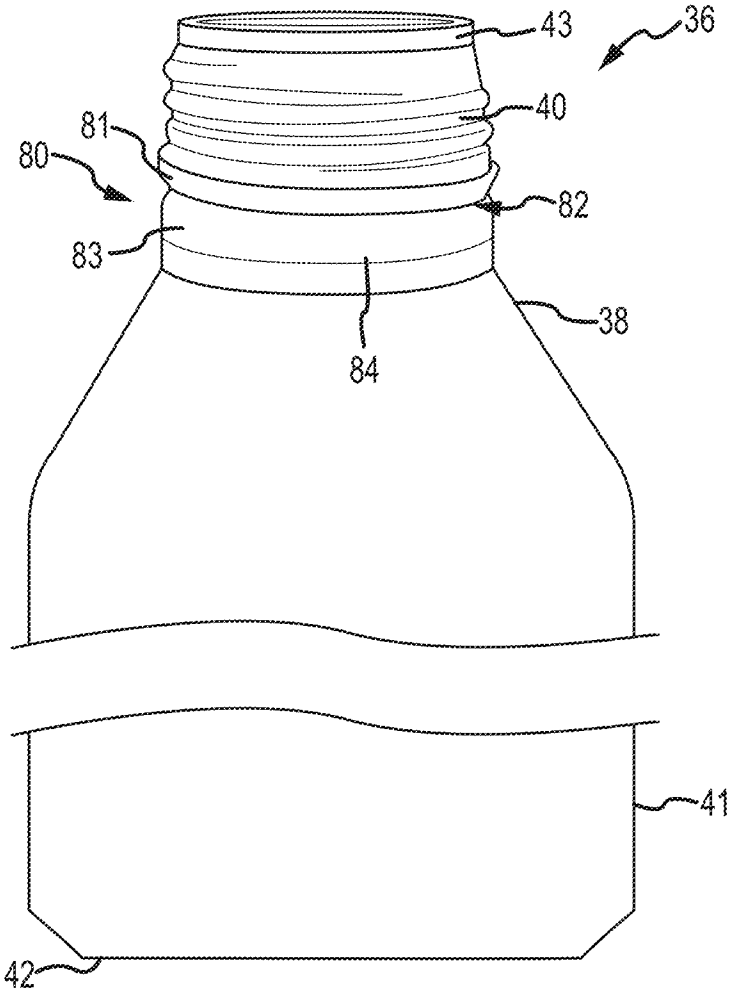
FIG. 8 is a front prospective view of the metallic bottle of FIG. 7 including a pilfer band retained on the bottle neck after a ROPP closure has been removed from the metallic bottle.

Referring now to FIG. 8, a metallic bottle 36 is illustrated with a pilfer band 80 retained on a neck portion 38 of the metallic bottle after a ROPP closure 70 has been removed from the metallic bottle. The pilfer band 80 includes a protrusion 82 such as illustrated in FIGS. 5-6. When the ROPP closure 70 is rotated in an opening direction, the protrusion 82 contacts a portion of an annular ring 44 formed on the neck portion 38 of the metallic bottle 36. The annular ring 44 prevents the protrusion 82 from moving toward the curl 43 of the metallic bottle 36 with the rest of the ROPP closure 70. As the ROPP closure 70 is rotated further in an opening direction, a serrated band 54 (generally illustrated in FIG. 5) of the ROPP closure becomes severed and the pilfer band 80 is retained on the bottle neck 38.

Figure 10:
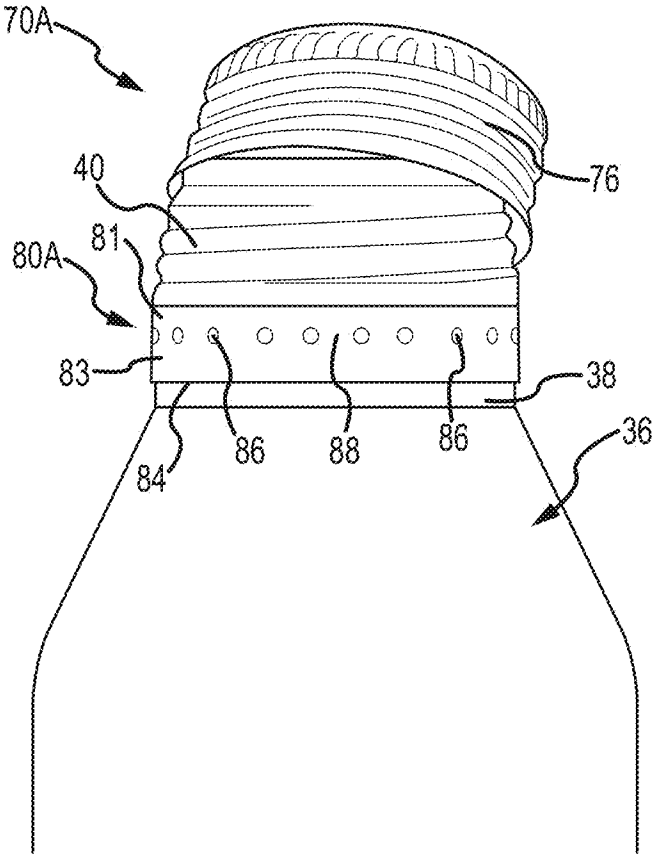
FIG. 10 is another partial front elevation view of the metallic bottle of FIG. 9 showing an upper portion of the ROPP closure separated from the pilfer band and illustrating the pilfer band retained on the neck portion of the metallic bottle.
Figure 9:
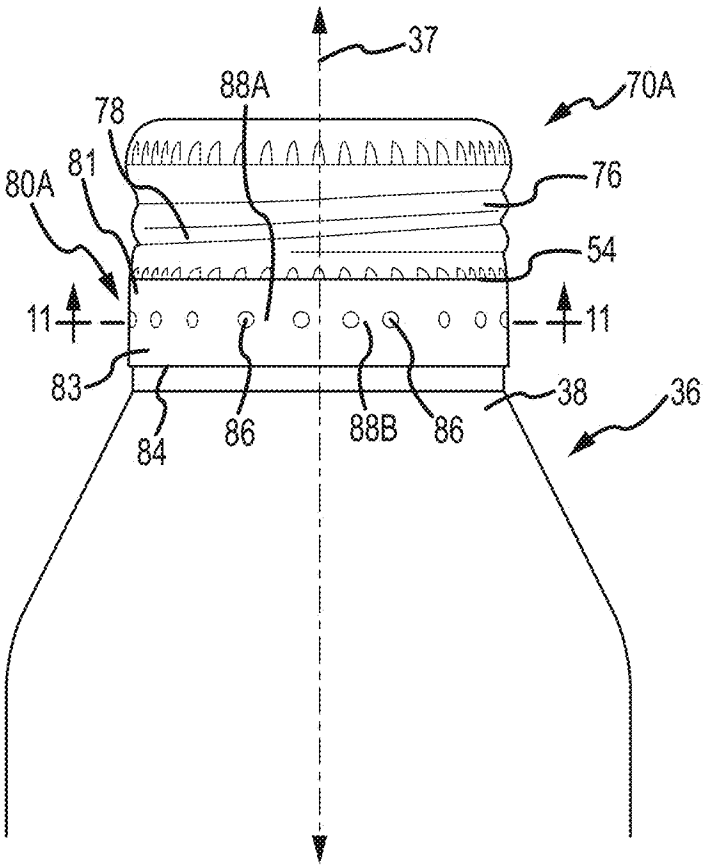
FIG. 9 is a partial front elevation view of a metallic bottle of the embodiment of FIG. 7 sealed with a ROPP closure including a pilfer band with a plurality of inwardly projecting studs of one embodiment of the present invention.

Referring now to FIGS. 9-12, another ROPP closure 70A of the present invention is generally illustrated. ROPP closure 70A is similar to ROPP closure 70 and includes many of the same features. However, when used to seal a bottle 36, a plurality of indentations or studs 86 are formed in the pilfer band 80A. The studs 86 project at least a predetermined distance into an annular ring 44 formed in the bottle 36. Accordingly, the studs 86 engage the bottle annular ring 44 when the ROPP closure 70A is rotated in an opening direction in a manner similar to the protrusion 82 of ROPP closure 70. Thus, the annular ring 44 applies a force to the studs 86 which severs a band of weakness 54 (illustrated in FIG. 9) of the ROPP closure 70A. In this manner, the pilfer band 80A is retained on the bottle neck 38 as generally illustrated in FIG. 10.

The studs 86 function in a manner similar to a protrusion 82 of pilfer bands 80 described herein. However, the protrusion 82 (which is generally illustrated in FIGS. 6, 8) has a substantially uniform cross-sectional profile and extends continuously around a circumference of the pilfer band. In contrast, the studs 86 are non-continuous around the circumference of the pilfer band.

Each of the studs 86 is separated, in one embodiment, from adjacent studs. Thus, a non-deformed portion 88 of the pilfer band 80A may separate each of the studs 86. More specifically, in one embodiment, each stud 86 is spaced from two adjacent studs 86 by non-deformed portions 88 of the pilfer band 80A. The non-deformed portions 88 between the studs 86 decreases the amount of force applied to the bottle 36 during formation of the studs 86 and as the ROPP closure 70 is positioned and sealed on the neck of the metallic bottle 36. Accordingly, the metallic bottle 36 can be formed of less material, or material of a thinner gage, than metallic bottles sealed with prior art ROPP closures 10. In this manner, the ROPP closure 70A with a pilfer band 80A including inwardly oriented studs 86 enables the use of lighter and more economical metallic bottles 36 than prior art ROPP closures.

In one embodiment, the studs 86 are substantially evenly spaced around a circumference of the pilfer band 80A. Alternatively, the studs 86 may be variably spaced around the pilfer band circumference. For example, in FIG. 9, non-deformed portion 88A has a greater width than non-deformed portion 88B.

The studs 86 may have any shape. In one embodiment, the studs 86 can optionally include an innermost portion that is pointed. In one embodiment, a stud 86 may have a plurality of innermost portions (or peaks) similar to a mountain. Alternatively, the pilfer band 80A may be pierced such that one or more of the studs 86 include an aperture or hole at an innermost portion. In one embodiment, the studs 86 are formed by local metal thinning of the pilfer band 80A rather than gross metal movement.

In one embodiment, the studs 86 have a generally oval cross section. In another embodiment, the studs 86 have a cross-section of an ellipse. Optionally, the studs 86 may have a tear drop cross-section. In one embodiment, the studs have a cross section of a circle, oval, triangle, square, or a star. Optionally, the studs 86 may comprise indicia, such as letters or numbers, embossed into the pilfer band 80A. Accordingly, in one embodiment, the studs 86 may be a portion of a logo or brand.

Figure 11:
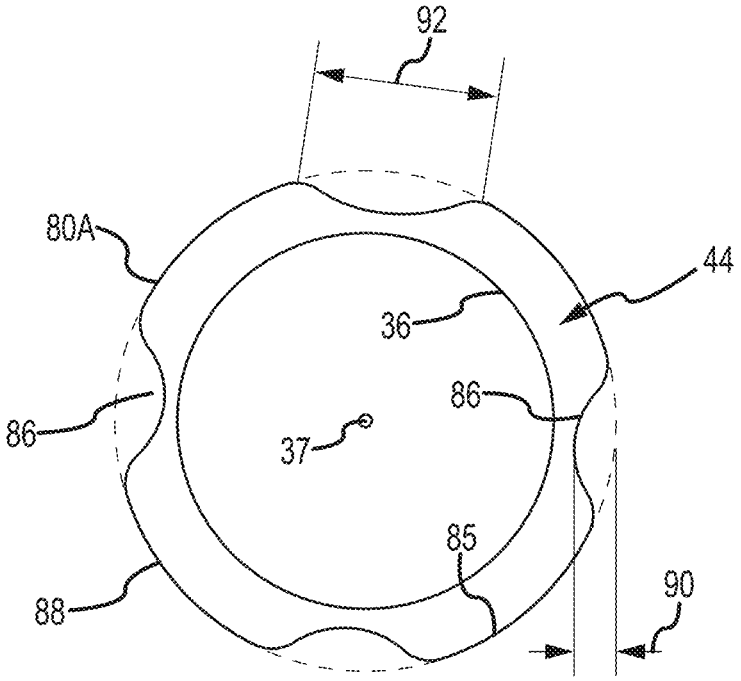
FIG. 11 is a cross sectional top plan view taken along line 11-11 of FIG. 9 showing the inwardly oriented studs of the pilfer band projecting into the annular ring of the metallic bottle.

Referring now to FIG. 11, the studs 86 extend inwardly from an interior surface 85 of the pilfer band 80A. The studs 86 have a predetermined depth 90 measured from the interior surface 85. In one embodiment, the studs 86 have a depth 90 of between about 0.02 inches and about 0.03 inches. In another embodiment, the depth 90 is up to about 0.03 inches. In one embodiment, the stud depth 90 is between about 0.025 inches and about 0.08 inches. Optionally, the stud depth 90 is approximately one-half of the difference between an exterior diameter of the pilfer band 80A and an interior diameter of the annular ring 44 of the bottle 36.

Although only four studs 86 are illustrated in FIG. 11, it will be appreciated that the pilfer band 80A of the present invention may have any number of studs 86. In one embodiment, the number of studs 86 is related to the diameter of the pilfer band. Accordingly, a ROPP closure 70A for a bottle with a large neck diameter will have more studs 86 than a ROPP closure for a bottle with a small neck diameter. The size of the studs 86 is substantially exaggerated in FIG. 11 for clarity.

Figure 12:
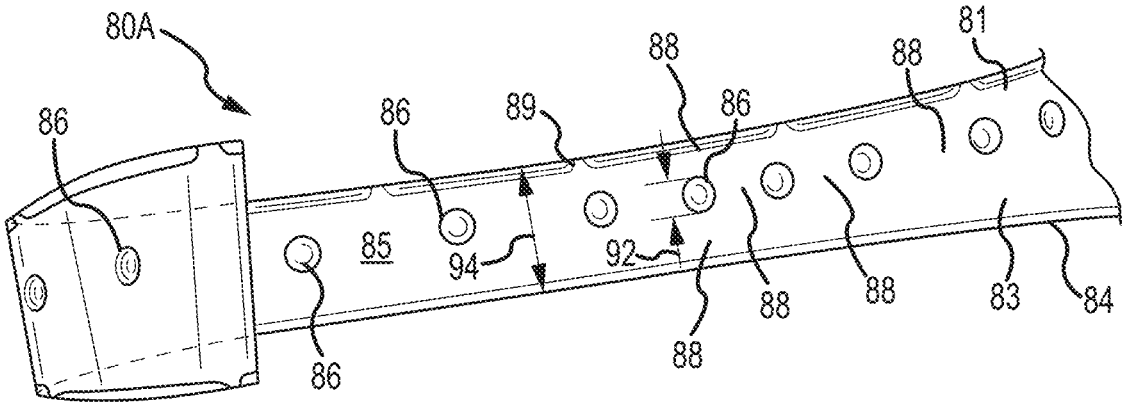
FIG. 12 is a perspective view of a pilfer band of one embodiment of the present invention cut open to show an interior surface of the pilfer band and a plurality of inwardly oriented studs.

Referring now to FIG. 12, each stud 86 has a width. In one embodiment, the studs 86 are substantially symmetric such that the width is approximately equal to the stud height 92. In one embodiment, the pilfer band 80A has a height 94 that is greater than the stud height 92. In one embodiment, the stud height 92 is substantially centered vertically on the pilfer band height 94. Accordingly, in one embodiment, a non-deformed portion 88 of the pilfer band 80A separates each stud 86 from a lowermost edge 84 of the pilfer band 80A. Optionally, the height 92 is less than about 0.2 inches. In another embodiment, the height 92 is less than about 0.1 inch. In another embodiment, the height 92 is at least about 0.03 inches. In one embodiment, the height 92 is greater than about 0.05 inches. Optionally, the height and the width of a stud 86 is between about 0.03 inches and about 0.2 inches. In another embodiment, the stud height and width are between about 0.05 inches and about 0.17 inches.

In one embodiment, the lower portion 83 of the pilfer band 80A below each stud 86 is not wavy (such as similar to a flute of a crown closure). More specifically, in one embodiment, an exterior diameter of the lower portion 83 of the pilfer band 80A is substantially uniform. As one of skill in the art will appreciate, a wavy or accordion shaped lower portion 83 of the pilfer band 80A would not be rigid. Thus, a pilfer band including a wavy portion below the studs would not be sufficiently rigid to cause a serrated band 54 to rupture when the ROPP closure is rotated in an opening direction.

In one embodiment, a non-deformed portion 88 of the pilfer band 80A separates each stud 86 from an uppermost edge 89 of the pilfer band 80A. Thus, the upper portion 81 of the pilfer band 80A is not wavy or accordion shaped. In one embodiment, the upper portion 81 has an exterior diameter that is substantially uniform. Optionally, each stud 86 is completely surrounded by non-deformed portions 88 of the pilfer band 80A.

In one embodiment, the studs 86 are formed by a tool including at least one punch. The punch generally has a diameter of up to about 0.08 inches. In another embodiment, the punch diameter is between about 0.04 inches and about 0.07 inches. Optionally, the punch includes a tip that is generally spherical. In one embodiment, the studs 86 formed by the punch have a depth 90 of up to about 0.25 inches.

Referring now to FIGS. 13A-13E, in one embodiment of the present invention, the studs 86 are formed by at least one stud roller 100 of capping apparatus 60A. The stud roller 100 generally comprises a shaft 102 and a head 104. The shaft 102 is configured to rotate axially around a longitudinal axis of the shaft. In one embodiment, the head 104 of the stud roller 100 has a shape that is generally cylindrical. Optionally, the capping apparatus 60A includes two stud rollers 100. In one embodiment, the stud rollers 100 replace pilfer rollers 68 of capping apparatus 60.

A plurality of punches 106 extend from the head 104. In one embodiment, the punches 106 extend approximately radially from the head. When forming the studs 86 on a pilfer band 80A of a ROPP closure 70A, the stud roller 100 moves around a circumference of the ROPP closure positioned on a neck 38 of a bottle 36. In one embodiment, the bottle 36 is a metallic bottle. As the stud roller 100 moves around the circumference of the ROPP closure 70A, individual punches 106 rotate into contact with the pilfer band 80A to form the studs 86. In one embodiment, the punches 106 do not penetrate the material of the pilfer band 80A. Alternatively, one or more of the punches 106 at least partially penetrate the pilfer band 80A.

Figure 13B:
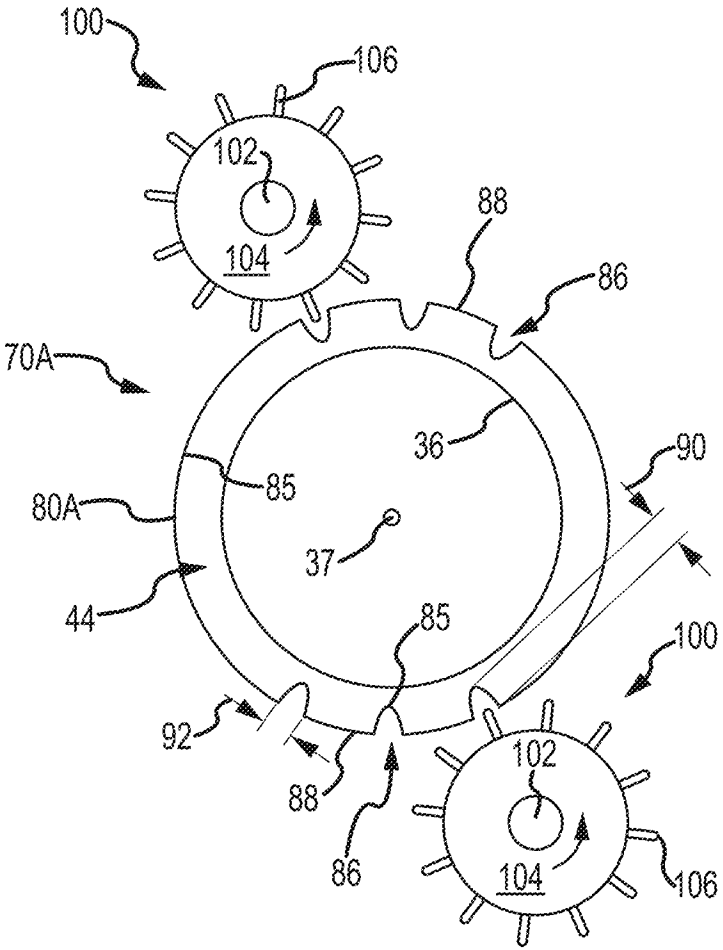
FIG. 13B is a cross-sectional top plan view of the capping apparatus taken along line 13B-13B of FIG. 13A and illustrating the stud roller forming studs in a pilfer band of a ROPP closure.
Figure 13A:
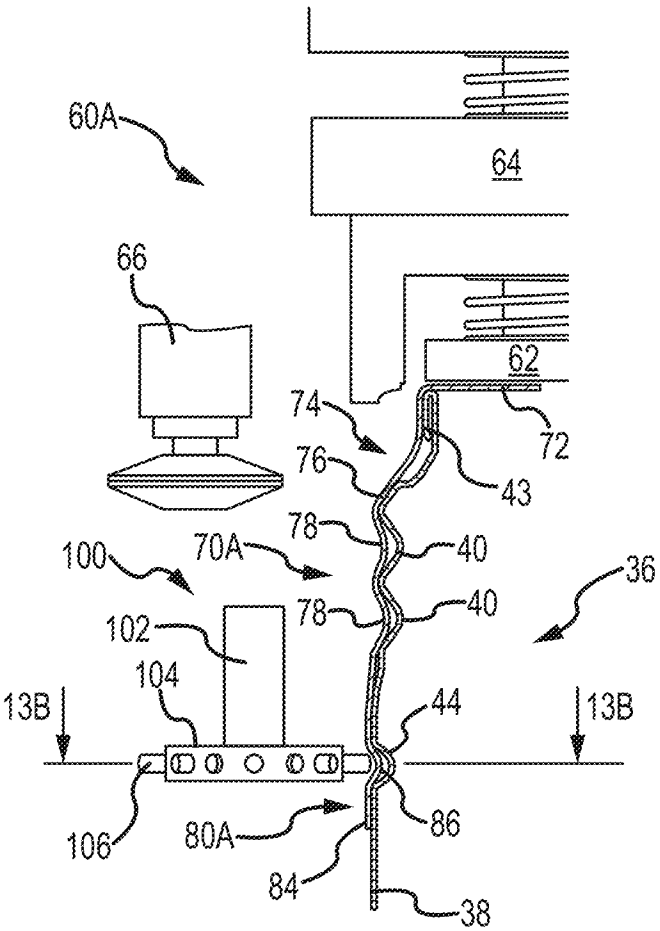
FIG. 13A is a cross-sectional front elevation view of another embodiment of a capping apparatus of the present invention which includes a stud roller.

Referring now to FIG. 13B, in one embodiment, a stud 86 formed by the stud roller 100 has a depth 90 of up to approximately 0.03 inches. In another embodiment, the depth 90 of the studs 86 formed by the punches 106 is between approximately 0.02 inches and approximately 0.03 inches. In another embodiment, the depth 90 is up to about 0.04 inches. In one embodiment, the stud depth 90 is between about 0.025 inches and about 0.1 inch. In another embodiment, the stud depth 90 is approximately half-way between an exterior diameter of the pilfer band 80A and an interior diameter of the bottle annular ring 44.

Studs 86 formed by the stud roller 100 have a predetermined width 92 and height. Optionally, the width 92 is less than about 0.2 inches. In another embodiment, the width 92 is less than about 0.1 inch. In another embodiment, the width 92 is at least about 0.03 inches. In one embodiment, the width 92 is greater than about 0.05 inches. Optionally, the width 92 is between about 0.03 inches and about 0.2 inches. In another embodiment, the width 92 is between about 0.05 inches and about 0.17 inches. In still another embodiment, the height of a stud is equal to the stud width 92.

Figure 13C:
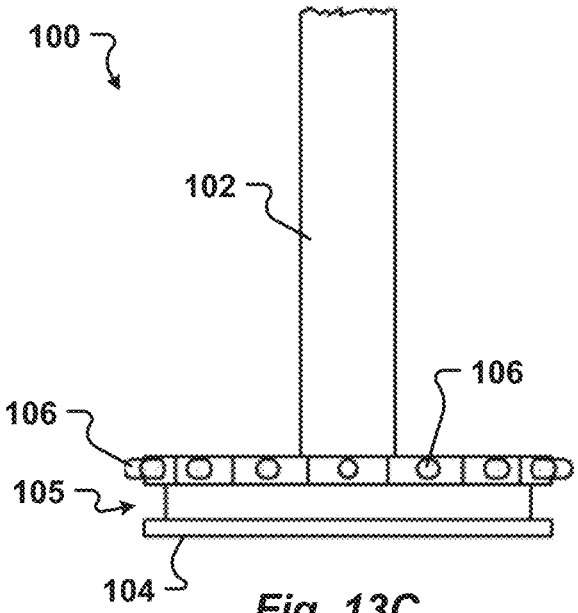
FIG. 13C is a partial front elevation view of the stud roller of FIG. 13A.
Figure 13D:
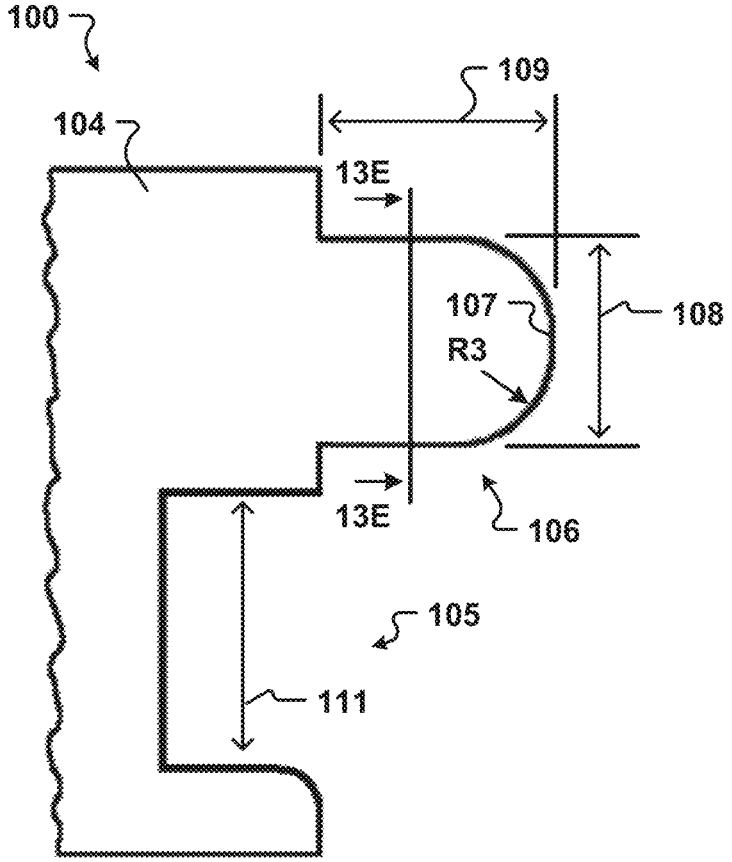
FIG. 13D is a longitudinal cross-sectional view of a portion of the stud roller of FIG. 13C.
Figure 13E:
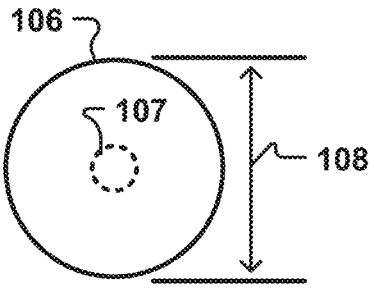
FIG. 13E is a cross-sectional view of a punch taken along line 13E-13E of FIG. 13C.

Referring now to FIGS. 13C-E, detailed views of a stud roller 100 of one embodiment of the present invention are illustrated. Any number of punches 106 can extend from the head 104. The punches 106 are substantially evenly spaced around the circumference of the head 106. In one embodiment, the stud roller 100 includes from 10 to 22 punches 106. In another embodiment, the stud roller has 16 punches.

In one embodiment, the head 104 of the stud roller 100 has a diameter of between approximately 1.1 inches and approximately 1.5 inches. Distal ends 107 of the punches define a second diameter. In one embodiment, the second diameter is between approximately 1.25 inches and approximately 1.65 inches.

Optionally, a recess or pocket 105 can be formed in the head 104. The pocket may be configured to receive a cushion, such as an o-ring. In one embodiment, the o-ring (not illustrated) is formed of a flexible or elastomeric material, such as rubber. Optionally, the pocket 105 may have a height 111 of between about 0.05 inches and about 0.2 inches. In one embodiment, the pocket 105 is spaced between approximately 0.02 inches and approximately 0.2 inches from a bottom portion of the head 104. Additionally, or alternatively, the pocket 105 may be spaced between approximately 0.05 inches and approximately 0.2 inches from a top portion of the head 14 from which the shaft 102 extends.

In one embodiment, the punches 106 have a diameter 108 of up to approximately 0.1 inch. In another embodiment, the punch diameter 108 is between about 0.04 inches and about 0.08 inches. The punches have a predetermined length 109 extending from the head 104. In one embodiment, the punch length 109 is less than about 0.1 inch. In another embodiment, the length 109 is greater than about 0.04 inches. In another embodiment, the stud length is between about 0.05 inches and about 0.09 inches.

The punches 106 can include a radius R3. In one embodiment, the radius R3 is between about 0.02 inches and about 0.06 inches.

Optionally, a tip or free end 107 of the punches 106 is generally spherical. In one embodiment, the tips of the punches 106 have a substantially uniform shape. Alternatively, at least one of the punches 106 has a tip with a different shape than others of the punches. In one embodiment, the punch free end 107 is substantially planar. Optionally, the planar free end 107 has a diameter of between approximately 0.003 inches and approximately 0.01 inches.

A center of the punch free end 107 is spaced a predetermined distance from the top portion of the head 104. In one embodiment, the distance between the top portion of the head 104 and a centerline of the punch free end 107 is between approximately 0.01 inches and approximately 0.1 inch.

Referring now to FIG. 13E, in one embodiment, a radial cross-section of the punches 106 has a shape that is generally circular. Other shapes of the punches 106 are contemplated. In another embodiment, the cross-sectional shape of the punches is selected to form a stud 86 having one of circle, oval, triangle, square, and a star shape. Optionally, a tip of at least one of the punches 106 may be shaped to form indicia, such as a letter or a number, on the pilfer band 80A. More specifically, in one embodiment, a distal end 107 of a punch 106 may be shaped to form a letter or a number similar to a key of a typewriter.

Figure 14:
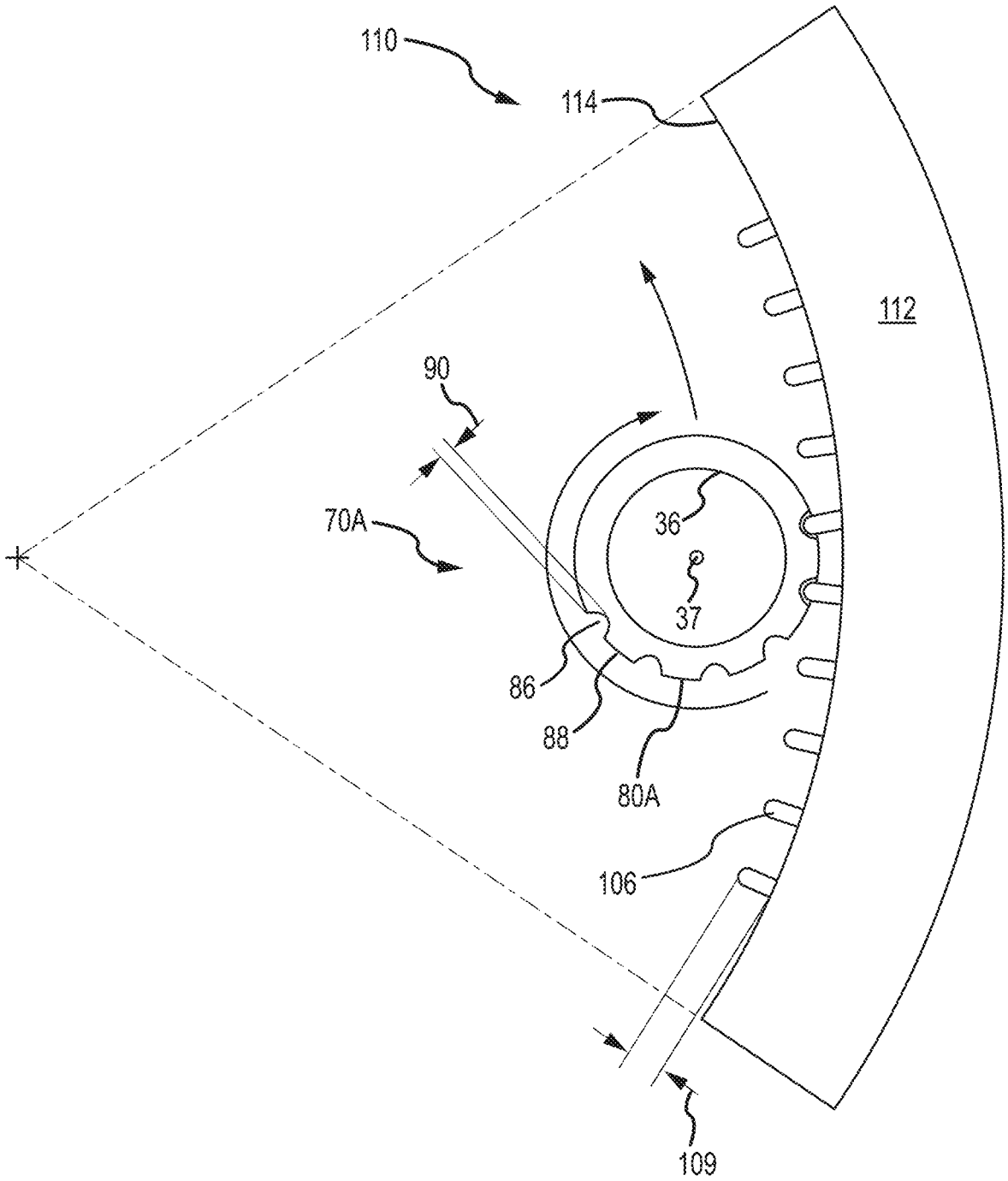
FIG. 14 is a top plan view of a studded rail engaging a pilfer band on a ROPP closure sealing a bottle according to one embodiment of the present invention.

Referring now to FIG. 14, in another embodiment of the present invention, the studs 86 are formed by a studded rail 110. The studded rail 110 generally includes a body 112. A plurality of punches 106 extend from a first side 114 of the body 110. In one embodiment, the first side 114 of the body 112 has a concave shape. More specifically, in one embodiment, the first side 114 of the body has an arcuate shape with a generally uniform radius of curvature. Optionally, each of the punches 106 extends from the first side generally parallel to a radius of the first side 114.

In one embodiment, the punches 106 are the same as, or similar to, the punches 106 of stud roller 100. Accordingly, in one embodiment, the punches 106 have a diameter 108 of up to approximately 0.1 inch. In another embodiment, the punch diameter 108 is between about 0.04 inches and about 0.08 inches. The punches have a predetermined length 109 extending from the first side 114 of the studded rail 110. In one embodiment, the punch length 109 is less than about 0.1 inch. In another embodiment, the length 109 is greater than about 0.04 inches. In another embodiment, the stud length is between about 0.05 inches and about 0.09 inches.

Optionally, a free end or tip of each of the punches 106 is generally spherical. In another embodiment, the punches have tips configured to form studs 86 shaped as one or more of a circle, an oval, a triangle, a square, a letter, and a number. The studs 86 extend a predetermined distance into the annular ring 44 of the bottle 36. The studs 86 formed by the studded rail 110 may have the same dimensions and geometry as the studs formed by the stud roller 100. In one embodiment, the studs 86 formed by the studded rail 110 have a depth 90 of up to approximately 0.03 inches. In another embodiment, the depth 90 of the studs 86 formed by the punches 106 is between approximately 0.02 inches and approximately 0.03 inches. In another embodiment, the depth 90 is up to about 0.04 inches. In one embodiment, the stud depth 90 is between about 0.025 inches and about 0.08 inches.

In operation, after a bottle 36 is filled with a product, a ROPP closure 70A is placed on a neck 38 the bottle. Threads are formed on the ROPP closure 70A by a thread roller 66 of a capping apparatus. The ROPP closure 70A is subsequently moved into contact with the punches 106 of the studded rail 110. In one embodiment, the studded rail 110 is separate from the capping apparatus 60. More specifically, in one embodiment, the studded rail 110 is positioned downstream from the capping apparatus. To form the studs 86, in one embodiment the bottle 36 and the ROPP closure 70A rotate around a longitudinal axis 37 of the bottle into contact with the punches 106. As the ROPP closure 70A rotates, successive punches 106 contact the pilfer band 80A to form individual studs 86 in the pilfer band. In one embodiment, the studded rail 110 is substantially stationary as the capped bottle 36 rotates against the studded rail. In another embodiment, the studded rail 110 moves with respect to the bottle 36 and the ROPP closure 70A to form the studs 86. Optionally, the bottle 36 and ROPP closure 70A can be substantially stationary as the studded rail 110 forms the studs. For example, in one embodiment, the studded rail 110 rotates around the ROPP closure 70A to form the studs 86.

Figure 15B:
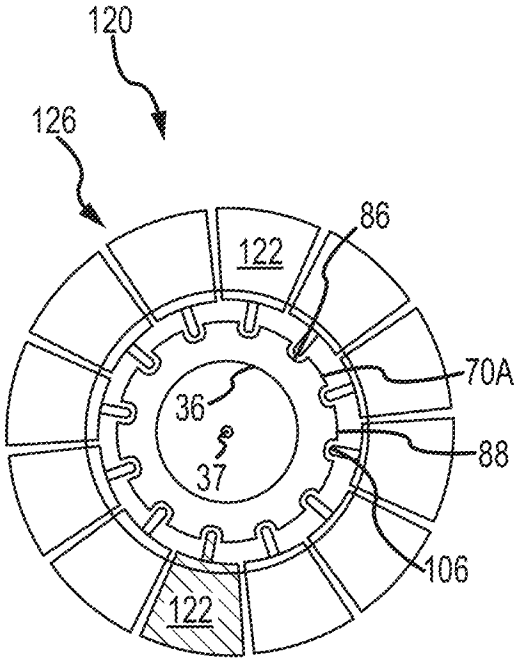
FIG. 15B is a top plan view of the stud forming tool of FIG. 15A.
Figure 15A:
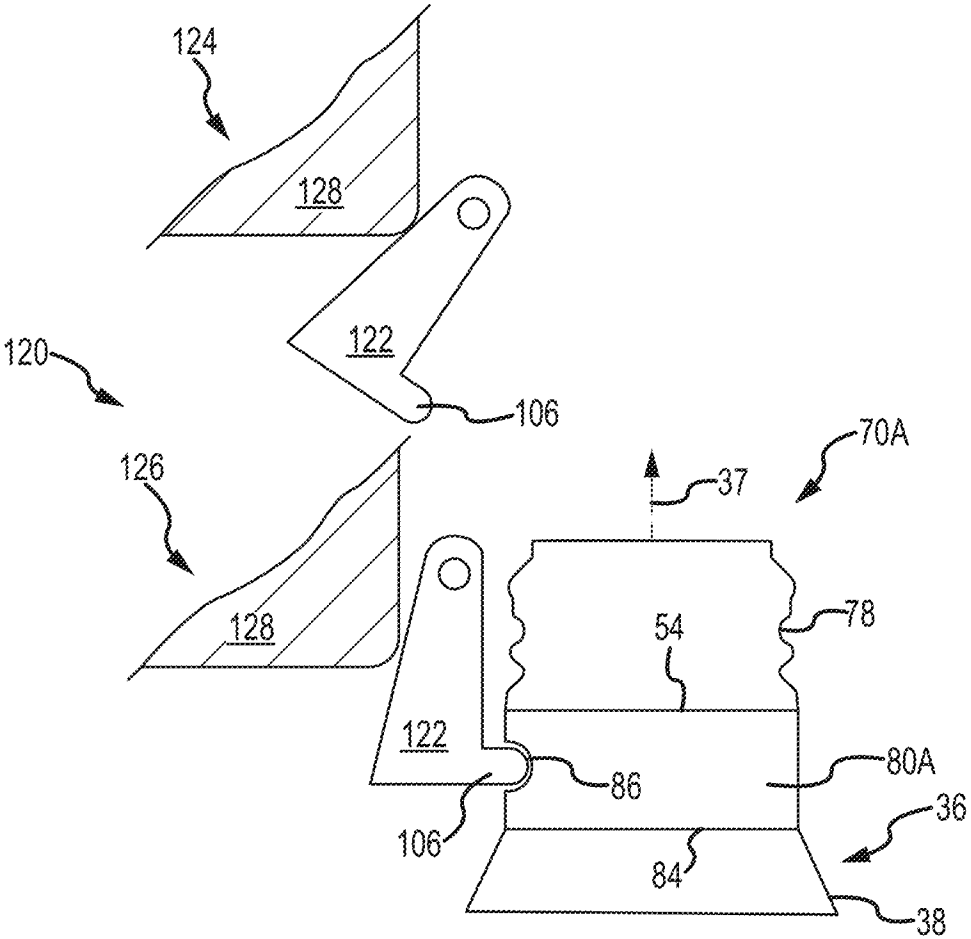
FIG. 15A is a partial cross-sectional front elevation view of a stud forming tool configured to form inwardly oriented studs in a pilfer band of a ROPP closure.

Referring now to FIGS. 15A-15B, another tool 120 for forming studs 86 in a ROPP closure 70A is generally illustrated. In one embodiment, the tool 120 includes a plurality of segments 122. Each of the plurality of segment 122 includes a punch 106.

Optionally, in one embodiment, the punches 106 are the same as, or similar to, punches of one or more of the stud roller 100 and the studded rail 110. Accordingly, the punches 106 of tool 100 may form studs 86 having a variety of shapes, including one or more of a circle, an oval, a triangle, a square, a letter, and a number. In one embodiment, the punches 106 have the same dimensions as the punches described in conjunction with the stud roller 100 and the studded rail 110. Accordingly, in one embodiment, the dimensions and geometry of the studs 86 formed by tool 120 are the same as, or similar to, the studs 86 formed by the stud roller 100 or the studded rail 110.

The punches 106 are oriented generally inwardly toward a ROPP closure 70A positioned on a neck portion 38 of a bottle 36. Optionally, the punches 106 are generally aligned with radii of the tool 120. In one embodiment, the plurality of segments 122 are arranged such that a cross-section of the tool 120 is generally circular and includes an opening or chamber to receive a ROPP closure 70A positioned on a bottle 36.

In one embodiment, the plurality of segments 122 are individually movable with respect to the ROPP closure 70A. In one embodiment, the plurality of segments 122 can move between a disengaged position 124 and an engaged position 126. Optionally, the plurality of segments 122 move in response to a force received from a collet 128. More specifically, the movement of the punches between the disengaged position 124 and the engaged position 126 is actuated by a collet 128.

In the engaged position, at least a distal end of the punch 106 contacts and applies a force to the ROPP closure 70A to form an indentation or a stud 86 in the pilfer band 80A. Optionally, the plurality of segments 122 are pivotally interconnected to the tool 120. Accordingly, in one embodiment, the plurality of segments 122 are configured to pivot between the disengaged position 124 and the engaged position 126. In another embodiment, a segment 122 moves generally parallel to a radii of the tool 120 between the disengaged position 124 and the engaged position 126.

In operation, after a bottle 36 is filled with a product, a ROPP closure 70A is placed on a neck 38 of the bottle. Threads 78 are formed on the ROPP closure 70A by a thread roller 66 of a capping apparatus, such as capping apparatus 60A; however, the capping apparatus does not form studs or a protrusion in the pilfer band 80A. The capped bottle 36 is subsequently moved into a predetermined alignment with the stud forming tool 120. In one embodiment, the stud forming tool 120 is positioned downstream from the capping apparatus. The ROPP closure 70A is aligned with an opening of the tool 120 between the studs 106 while the segments are in the disengaged position 124. The tool 120 then moves the plurality of segments 122 to the engaged position 126 and the punches 106 contact the pilfer band 80A to form the studs 86. The tool 120 then moves the plurality of segments 122 to the disengaged position 124 and the capped bottle 36 is removed from the tool.

The stud forming tool 120 may be installed in a prior art capping apparatus. For example, in one embodiment, the stud forming tool 120 may be installed in any prior art capping apparatus that has a vertical motion. The stud forming tool 120 does not require rotary motion. In another embodiment, the stud forming tool 120 is installed in a crown capping apparatus such as those known to one of skill in the art.

Referring now to FIGS. 16A-16D, another tool 130 of the present invention is generally illustrated. The tool 130 is configured to form studs 86 on a ROPP closure 70A positioned on a neck 38 of a bottle 36. In one embodiment, the stud forming tool 130 is positioned downstream from a capping apparatus, such as a capping apparatus similar to capping apparatus 60 or 60A. Accordingly, the stud forming tool 130 receives a bottle 36 capped by a ROPP closure 70A on which closure threads have previously been formed.

The tool 130 generally includes a plurality of segments or carriers 132 and a cam 138. Each of the plurality of carriers 132 has an inwardly facing punch 106. More specifically, each of the plurality of carriers 132 include an interior surface 134. The punches 106 extend from the interior surfaces 134 of the plurality of carriers 132. In one embodiment, each of the plurality of carriers 132 includes one punch 106. The punches 106 have the same, or similar, dimensions as the punches 106 described in conjunction with the stud roller 100 and the studded rail 110.

The interior surfaces 134 of each of the plurality of carriers 132 define an opening or chamber 136. The chamber 136 is configured to receive a ROPP closure 70A positioned on the neck of a bottle 36. In one embodiment, the chamber 136 defined by the interior surfaces 134 has a shape that is generally circular. In another embodiment, the chamber 136 has a shape that is not circular. The capped bottle 36 is positioned within the chamber 136 such that a pilfer band 80A of the ROPP closure is in a predetermined alignment with respect to the punches 106.

Each punch 106 is configured to move from a disengaged position to an engaged position. In the disengaged position, the punch 106 does not contact the ROPP closure 70A. In contrast, in the engaged position, the punch applies a force to the ROPP closure 70A to form a stud 86 in the pilfer band 80A.

In one embodiment, the punches 106 move to the engaged position in response to a force received from the cam 138. The cam 138 is configured to rotate around the plurality of carriers 132. In one embodiment, the cam contacts an exterior surface 135 of each of the plurality of carriers. In another embodiment, as the cam rotates around the plurality of carriers 132, the cam rotates around an axis 140. Optionally, the cam 138 has an exterior surface that is generally round. Alternatively, the exterior surface of the cam 138 is eccentric or elliptical. Optionally, the stud forming tool 130 can include two or more cams 138.

Figure 16B:
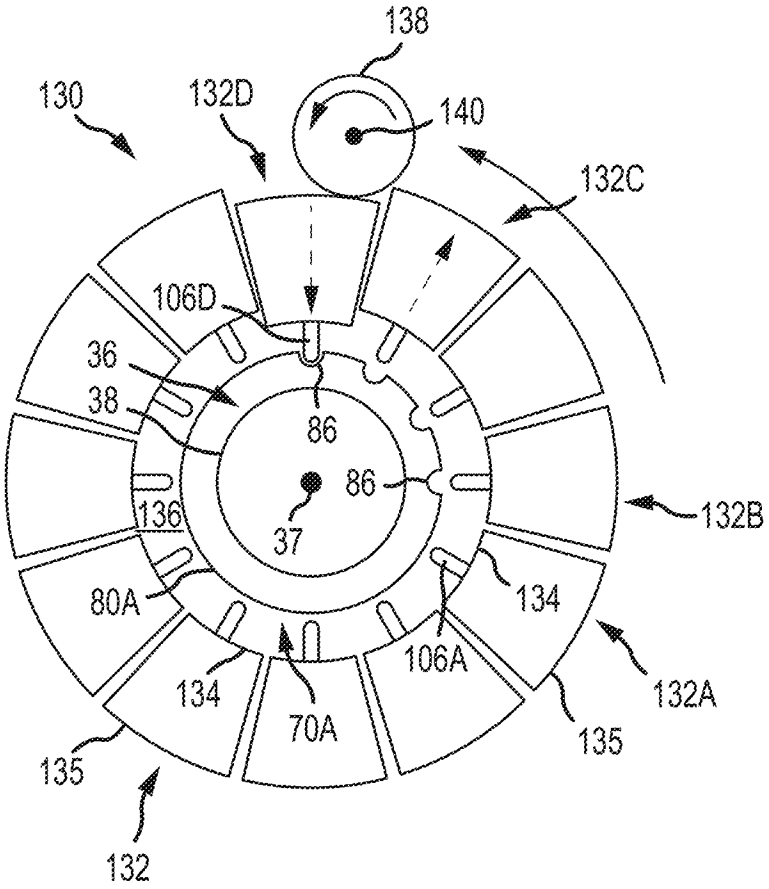
FIG. 16B is another view of the tool of FIG. 16B illustrating the cam in another position of use.
Figure 16A:
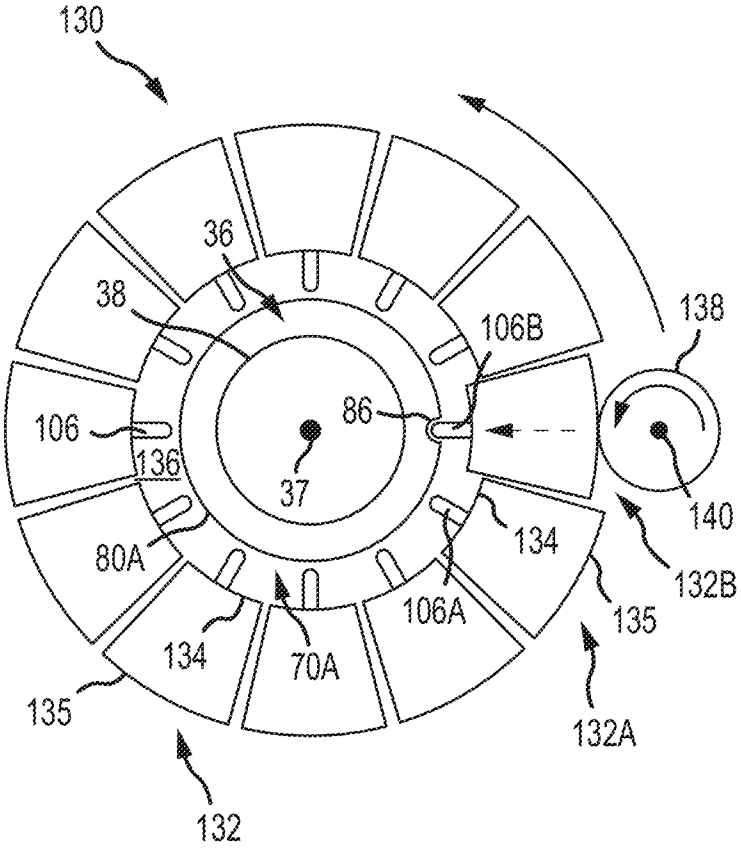
FIG. 16A is a partial top plan view depicting a tool with a plurality of individual punches activated by a cam according to another embodiment of the present invention.
Figure 16E:
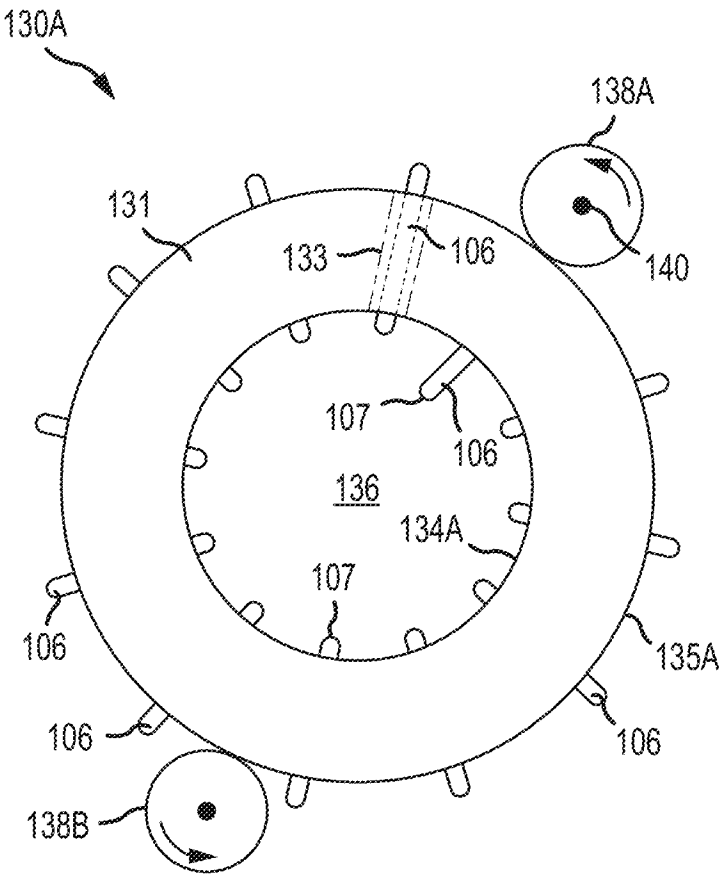
FIG. 16E is a top plan view of a stud forming tool of another embodiment of the present invention.

As illustrated in FIGS. 16A-16B, in one embodiment, the punches 106 are immovably interconnected to the plurality of carriers 132. Accordingly, both a carrier 132 and an associated punch 106 move in response to a force received from the cam 138. More specifically, punch 106A associated with carrier 132A is illustrated in a disengaged position as the cam 138 is not in contact with carrier 132A. In one embodiment, each carrier of the plurality of carriers is biased outwardly in the disengaged position. In contrast, carrier 132B has moved inwardly compared to carrier 132A in response to a force received from cam 138. The inward movement of carrier 132B causes its associated punch 106B to move into an engaged position in contact with the closure pilfer band 80A to form a stud 86.

Figure 16C:
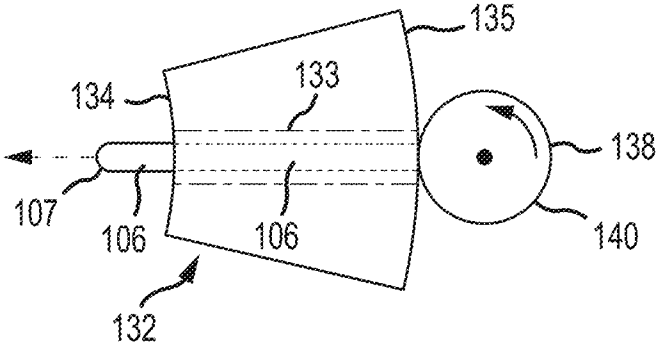
FIG. 16C is a top plan view of a carrier of the tool of FIG. 16A illustrating a punch in an engaged position.
Figure 16D:
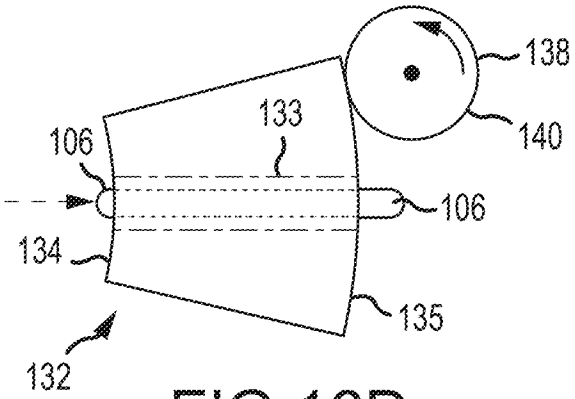
FIG. 16D is a top plan view of the carrier of FIG. 16C and illustrating the punch in a disengaged position.

Alternatively, as illustrated in FIGS. 16C-16D, the punches 106 can optionally be moveably interconnected to each of the plurality of carriers 132. Accordingly, as generally illustrated in FIG. 16C, when the cam 138 applies a force to a punch 106, the punch moves inwardly and a distal end 107 of the punch extends an increased distance from an interior surface 134 of the carrier 132. In this manner, the punch 106 moves to the engaged position.

As illustrated in FIG. 16D, the cam 138 continues to move with respect to the carrier such that the cam does not contact the punch 106. The punch 106 then retracts or moves outwardly into the disengaged position. Optionally, in the disengaged position, a portion of the punch 106 may extend beyond an exterior surface 135 of the carrier 132. In one embodiment, the carrier 132 is substantially stationary as the punch 106 moves from a disengaged position to an engaged position.

In one embodiment, the carrier 132 includes an aperture 133. The punch 106 extends through the aperture 133. Optionally, the punches 106 are biased outwardly with respect to the carriers 132. More specifically, the punches can be biased to the disengaged position.

Referring now to 16E, another embodiment of the stud forming tool 130A of the present invention is generally illustrated. The stud forming tool 130A generally includes a body 131 and at least one cam 138. The body 131 generally includes an exterior surface 135A and an interior surface 134A which defines a chamber 136. In one embodiment, the body 131 has a shape similar to a ring. The chamber 136 is configured to receive a bottle 36 capped by a ROPP closure 70A the same as or similar to the chamber 136 of stud forming tool 130. In one embodiment, the chamber 136 has an interior diameter which is greater than an exterior surface of a pilfer band 80A of a ROPP closure 70A.

A plurality of punches 106 extend through the body 131. A distal end 107 of each of the plurality of punches is oriented toward the chamber 136. The plurality of punches are movably interconnected to the body 131. Optionally, the plurality of punches 106 are biased outwardly in a disengaged position. In one embodiment, when in the disengaged position, a portion of each of the plurality of punches extends outwardly from the exterior surface 135A of the body 131. In one embodiment, the body 131 includes a plurality of apertures 133 through which the punches extend.

In operation, a bottle 36 capped by a ROPP closure 70A (not illustrated for clarity) is positioned within the chamber 136. The cam 138 rotates around the body 131. As the cam moves, the cam contacts each of the plurality of punches 106. In response to a force received from the cam 138, each of the plurality of punches move inwardly from the disengaged position to the engaged position. Each of the plurality of punches 106 contact the pilfer band 80A to form a stud 86. In this manner, the plurality of punches 106 form a plurality of studs 86 in the pilfer band 80A of the ROPP closure 70A.

Optionally, the stud forming tool 130A includes at least two cams 138A, 138B. In one embodiment, the cams 138A, 138B are offset such that only one punch 106 is contacted by a cam 138A, 138B at once. More specifically, the cams 138A, 138B can be oriented with respect to the body 131 such that when the first cam 138A contacts a punch 106, the second cam 138B does not contact a punch. Alternatively, in another embodiment, the cams 138A, 138B can contact two punches 106 such that the two punches move to the engaged position substantially simultaneously.

In one embodiment, the dimensions and geometry of the studs 86 formed by tools 130, 130A are the same as, or similar to, the studs 86 formed by the stud roller 100 or the studded rail 110. Optionally, the stud forming tools 130, 130A can be installed on a prior art capping device. For example, in one embodiment, the stud forming tools 130, 130A are installed on a prior art capping device that has a vertical and rotary motion. In one embodiment, a plastic screw cap torqueing capper is modified to include one of the stud forming tools 130, 130A. Accordingly, the plastic screw capper can be modified to form studs 86 on a bottle 36 with the stud forming tool 130 or 130A of the present invention.

The description of the present invention has been presented for purposes of illustration and description, but is not intended to be exhaustive or limiting of the invention to the form disclosed. Many modifications and variations will be apparent to those of ordinary skill in the art. The embodiments described and shown in the figures were chosen and described in order to best explain the principles of the invention, the practical application, and to enable those of ordinary skill in the art to understand the invention.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention, as set forth in the following claims.

What is claimed is:

1. A threaded metallic container sealed with a roll-on pilfer proof (ROPP) closure, comprising:
- a neck;
- container threads formed on at least a portion of the neck;
- an annular ring formed in the neck below the container threads, the annular ring configured to receive and retain a portion of the ROPP closure;
- an opening positioned on an uppermost portion of the neck; and
- the ROPP closure positioned on the neck and including:
  - a closed end-wall;
  - a body portion extending downwardly from the closed end-wall;
  - closure threads formed in a portion of the body portion;
  - a pilfer band releasably interconnected to the body portion; and
  - at least one inwardly oriented protrusion formed in the pilfer band and extending into the annular ring of the threaded metallic container, wherein the pilfer band includes:
    - an upper portion proximate to the body portion of the ROPP closure and located above the at least one inwardly oriented protrusion;
    - a medial portion including the at least one inwardly oriented protrusion; and
    - a lower portion located proximate to a lowermost portion of the ROPP closure, the lower portion extending below a lowermost portion of the annular ring.

2. The threaded metallic container of claim 1, wherein a serrated band or a score separates the upper portion of the pilfer band from the body portion of the ROPP closure.

3. The threaded metallic container of claim 1, wherein an interior diameter of the at least one inwardly oriented protrusion is less than an interior diameter of the lower portion of the pilfer band.

4. The threaded metallic container of claim 1, wherein the upper and lower portions of the pilfer band are generally cylindrical and the lower portion has an interior diameter that is about equal to an interior diameter of the upper portion.

5. The threaded metallic container of claim 1, wherein the annular ring is spaced axially from a lowermost portion of the container threads.

6. The threaded metallic container of claim 1, wherein the annular ring has a height of between approximately 0.025 inches and approximately 0.2 inches and the annular ring has a depth of at least about 0.03 inches.

7. The threaded metallic container of claim 1, wherein a portion of the neck above the annular ring and a portion of the neck below the annular ring have diameters that are substantially equal.

8. The threaded metallic container of claim 7, wherein the neck portion above the annular ring is generally cylindrical and the neck portion below the annular ring is generally cylindrical.

9. The threaded metallic container of claim 1, wherein the annular ring has a cross-sectional geometric profile with at least one of a U-shape, a V-shape, and an open box with three sides.

10. A method of retaining a roll-on pilfer proof (ROPP) closure on a threaded metallic bottle, comprising:
- providing the threaded metallic bottle, comprising:
  - a neck;
  - container threads formed on at least a portion of the neck;
  - an annular ring formed in the neck and positioned below a lowermost portion of the container threads, the annular ring configured to receive and retain a portion of the ROPP closure; and
  - an opening positioned on an uppermost portion of the neck;
- positioning the ROPP closure on the neck of the threaded metallic bottle, the ROPP closure including:
  - a closed end-wall;
  - a body portion extending downwardly from the closed end-wall;
  - a pilfer band releasably interconnected to the body portion, the pilfer band including:
    - an upper portion proximate to the body portion of the ROPP closure;
    - a medial portion; and
    - a lower portion located proximate to a lowermost portion of the ROPP closure, the lower portion extending below a lowermost portion of the annular ring;
- applying a downwardly oriented force to the closed end-wall of the ROPP closure;
- forming closure threads in a portion of the body portion of the ROPP closure; and
- pressing the medial portion of the pilfer band of the ROPP closure inwardly at least partially into the annular ring of the threaded metallic bottle to form at least one inwardly oriented protrusion in the medial portion that extends into the annular ring of the threaded metallic container, wherein the upper portion of the pilfer band is located above the at least one inwardly oriented protrusion, and wherein the ROPP closure is retained to prevent travel in a direction substantially parallel to a longitudinal axis of the threaded metallic bottle.

11. The threaded metallic container of claim 1, wherein the at least one inwardly oriented protrusion comprises an inwardly oriented protrusion extending around a circumference of the pilfer band.

12. The threaded metallic container of claim 11, wherein the inwardly oriented protrusion is formed by a roller which applies a force to the pilfer band.

13. The threaded metallic container of claim 1, wherein the at least one inwardly oriented protrusion comprises a plurality of individual studs in the pilfer band.

14. The threaded metallic container of claim 13, wherein the plurality of individual studs do not penetrate the pilfer band.

15. A threaded metallic bottle adapted to be sealed by a roll-on pilfer proof (ROPP) closure, comprising:

a closed end-wall;

a sidewall extending upwardly from the closed end-wall;

a neck extending upwardly from the sidewall;

threads formed on at least a portion of the neck;

an opening positioned on an uppermost portion of the neck; and an annular ring formed in the neck below the threads, the annular ring configured to receive a portion of a pilfer band of the ROPP closure, wherein the annular ring has a substantially U-shaped cross-sectional profile, and wherein an upper neck portion above the annular ring is generally cylindrical and a lower neck portion below the annular ring is generally cylindrical.

16. The threaded metallic bottle of claim 15, further comprising a ROPP closure positioned on the neck, the ROPP closure including:

closure threads engaging the threads of the threaded metallic bottle; and the pilfer band which includes:

an upper portion severably interconnected to the ROPP closure;

a medial portion including at least one protrusion extending inwardly into the annual ring; and a lower portion extending below a lowermost portion of the annular ring, wherein the ROPP closure cannot be disengaged from the neck of the threaded metallic bottle without severing the pilfer band at least partially from the ROPP closure.

17. The threaded metallic bottle of claim 16, wherein the at least one protrusion extends around the pilfer band.

18. The threaded metallic bottle of claim 16, wherein the at least one protrusion comprises a plurality of individual protrusions separated by non-deformed portions of the pilfer band, and wherein the individual protrusions do not extend through the pilfer band.

19. The threaded metallic bottle of claim 15, wherein the upper neck portion above the annular ring is substantially concentric to the lower neck portion below the annular ring.

20. The threaded metallic bottle of claim 19, wherein the upper neck portion has an exterior diameter that is approximately equal to an exterior diameter of the lower neck portion.

* * * * *